US008676100B2

(12) United States Patent
Shimizu et al.

(10) Patent No.: US 8,676,100 B2
(45) Date of Patent: Mar. 18, 2014

(54) IMAGE FORMING APPARATUS USING ELECTROSTATIC IMAGE REGISTRATION CONTROL

(75) Inventors: Hisae Shimizu, Tokyo (JP); Ichiro Okumura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 103 days.

(21) Appl. No.: 13/281,015

(22) Filed: Oct. 25, 2011

(65) Prior Publication Data

US 2012/0107024 A1 May 3, 2012

(30) Foreign Application Priority Data

Oct. 29, 2010 (JP) ..... 2010-244590

(51) Int. Cl.
*G03G 15/01* (2006.01)

(52) U.S. Cl.
USPC ..... 399/301

(58) Field of Classification Search
USPC ..... 399/301, 394, 395, 396; 347/116
See application file for complete search history.

(56) References Cited

U.S. PATENT DOCUMENTS

| | | | | |
|---|---|---|---|---|
| 6,205,306 | B1 | 3/2001 | Ishida | |
| 2009/0123197 | A1* | 5/2009 | Okumura et al. | 399/301 |
| 2010/0226696 | A1* | 9/2010 | Shihoh et al. | 399/301 |
| 2012/0008995 | A1* | 1/2012 | Shigemura et al. | 399/301 |

FOREIGN PATENT DOCUMENTS

| | | | |
|---|---|---|---|
| CN | 1216834 | A | 5/1999 |
| JP | 10-039571 | A | 2/1998 |
| JP | 2004-145077 | A | 5/2004 |
| JP | 2007-171752 | A | 7/2007 |
| JP | 2010-060761 | A | 3/2010 |

OTHER PUBLICATIONS

Office Action issued in Chinese Application No. 201110332651.7 dated Jan. 6, 2014.

* cited by examiner

*Primary Examiner* — Sophia S Chen
(74) *Attorney, Agent, or Firm* — Fitzpatrick, Cella, Harper & Scinto

(57) ABSTRACT

An image forming apparatus includes first and second image bearing members, a belt member contacting the first and second image bearing members, first and second electrostatic image forming portions for respectively forming electrostatic images on the first and second image bearing members, first and second developing portions for forming toner images on the basis of the electrostatic images formed on the first and second image bearing members, first and second transfer portions for transferring onto the belt member the toner images formed on the first and second image bearing members and/or electrostatic image indices formed by the electrostatic image forming portions, first and second detecting portions for detecting the electrostatic image indices which are formed by the electrostatic image forming portions, and an adjusting portion for adjusting a forming operation of an image to be formed on the belt member on the basis of outputs of the first and second detecting portions, and a belt member charging portion for electrically charging the belt member before transfer of the electrostatic image indices.

9 Claims, 18 Drawing Sheets

(a)

(b)

IMAGE FORMING APPARATUS USING ELECTROSTATIC IMAGE REGISTRATION CONTROL

FIELD OF THE INVENTION AND RELATED ART

The present invention relates to an image forming apparatus in which an electrostatic image for positioning (alignment) formed on an image bearing member is transferred onto a belt member and then is used for registration (alignment) control of toner images for an image. Specifically, the present invention relates to a constitution for enhancing detection accuracy by properly transferring the electrostatic image for positioning onto an intermediary transfer member or the like.

An image forming apparatus in which a toner image for an image obtained by developing an electrostatic image formed on an image bearing member is subjected to positioning (alignment) control by using a belt member (intermediary transfer belt or recording material conveyer belt) has been widely used. In the image forming apparatus in which the toner image for the image formed on an upstream image bearing member and the toner image for the image formed on a downstream (another) image bearing member are superposed (positionally aligned) by using the belt member, various indexes or codes (scales) are formed outside an image transfer area of the belt member (Japanese Laid-Open Patent application (JP-A) Hei 10-39571 and JP-A 2004-145077).

In JP-A Hei 10-39571, in order to adjust timing of formation of electrostatic images for images on a plurality of image bearing members, in advance of image formation, electrostatic image indexes for positioning are formed on the plurality of image bearing members and then are transferred onto the recording material conveyer belt.

In JP-A 2004-145077, in order to positionally aligning the toner image on the image bearing member with the toner image for the image transferred onto the intermediary transfer belt in real time, a code (scale) pattern is magnetically recorded on a magnetic recording track of the intermediary transfer belt.

In JP-A 2010-60761, an antenna potential sensor capable of detecting the electrostatic image indexes formed on the image bearing member (photosensitive drum) is described. The antenna potential sensor includes, as shown in FIG. 6, a detecting surface and a lead wire parallel to the electrostatic image indexes disposed at predetermined intervals. The antenna potential sensor is very small in size and in addition, outputs a detection signal of a differential waveform of a potential distribution on the detecting surface when the sensor passes through the electrostatic image indexes, so that the antenna potential sensor can precisely detect the electrostatic image indexes.

As shown in FIG. 1, control such that an electrostatic image index 31*a* for positioning formed by an upstream image bearing member 12*a* is transferred onto a belt member 24 and is detected by an antenna reading sensor 33*b* to positionally align the toner image for the image on a downstream image bearing member 12*b* in real time has been proposed.

In this case, with respect to the upstream image bearing member 12*a*, at a position in which the toner image is transferred onto the belt member 24, the electrostatic image index 31*a* may desirably be transferred onto the belt member 24 simultaneously. This is because a phase relationship between the toner image on the upstream image bearing member 12*a* and the electrostatic image index 31*a* is equally reproduced on the belt member 24 at a scanning line level to reduce a toner image registration (alignment) error with respect to the downstream image bearing member 12*b*.

However, as a result of study, it was turned out that a transfer voltage for permitting transfer of the toner image for the image with a maximum transfer efficiency and a transfer voltage for permitting transfer of the electrostatic image index with high accuracy are different from each other (FIG. 11). Further, it was turned out that the potential difference between the transfer voltage for permitting transfer of the toner image for the image with a maximum transfer efficiency and the transfer voltage for permitting transfer of the electrostatic image index with high accuracy varies largely depending on a cumulative number of sheets subjected to image formation and ambient temperature and humidity.

For this reason, when the transfer voltage for permitting transfer of the electrostatic image index with high accuracy was set, the toner image for the image was lowered and thus an image quality was lowered. Further, when the transfer voltage for permitting transfer of the toner image for the image with a high transfer efficiency was set, the electrostatic image index transferred onto the belt member was impaired and thus the toner image registration error became large.

Therefore, as shown in FIG. 8, a constitution in which independent transfer rollers 47 each for transferring an electrostatic image index 31*a* are provided coaxially with a transfer roller 4*a* for transferring the toner image and an optimum transfer voltage is applied to each of the toner rollers 4*a* and 47 has been proposed. However, in this case, a structure of a transfer portion Ta becomes complicated. There is a need to provide a space for avoiding electric discharge between the transfer roller 4*a* and the transfer roller 47, so that a width of the intermediary transfer belt 24 is expanded and thus a size of an intermediary transfer unit (by extension to the image forming apparatus) is increased.

SUMMARY OF THE INVENTION

A principal object of the present invention is to provide an image forming apparatus capable of realizing an improvement in registration (positional alignment) of toner images with an electrostatic image (alignment) index by suitably transferring the toner images for an image and the electrostatic image index.

According to an aspect of the present invention, there is provided an image forming apparatus comprising:

a first image bearing member;

a belt member contacting the first image bearing member;

first electrostatic image forming means for forming an electrostatic image for an image on the first image bearing member;

first developing means for forming a toner image on the basis of the electrostatic image formed on the first image bearing member;

first transfer means for transferring onto the belt member the toner image formed on the first image bearing member and an electrostatic image index formed by the electrostatic image forming means;

a first detecting portion for detecting the electrostatic image index which is formed by the electrostatic image forming means and is transferred from the first image bearing member onto the belt member;

a second image bearing member contacting the belt member;

second electrostatic image forming means for forming an electrostatic image for an image on the second image bearing member;

second developing means for forming a toner image on the basis of the electrostatic image formed on the second image bearing member;

second transfer means for transferring the toner image from the second image bearing member onto the belt member;

a second detecting portion for detecting an electrostatic image index formed on the second image bearing member;

adjusting means for adjusting a forming operation of an image to be formed on the belt member on the basis of an output of the first detecting portion and an output of the second detecting portion; and belt member charging means for electrically charging the belt member before transfer of the electrostatic image index.

These and other objects, features and advantages of the present invention will become more apparent upon a consideration of the following description of the preferred embodiments of the present invention taken in conjunction with the accompanying drawings.

Figure 4:
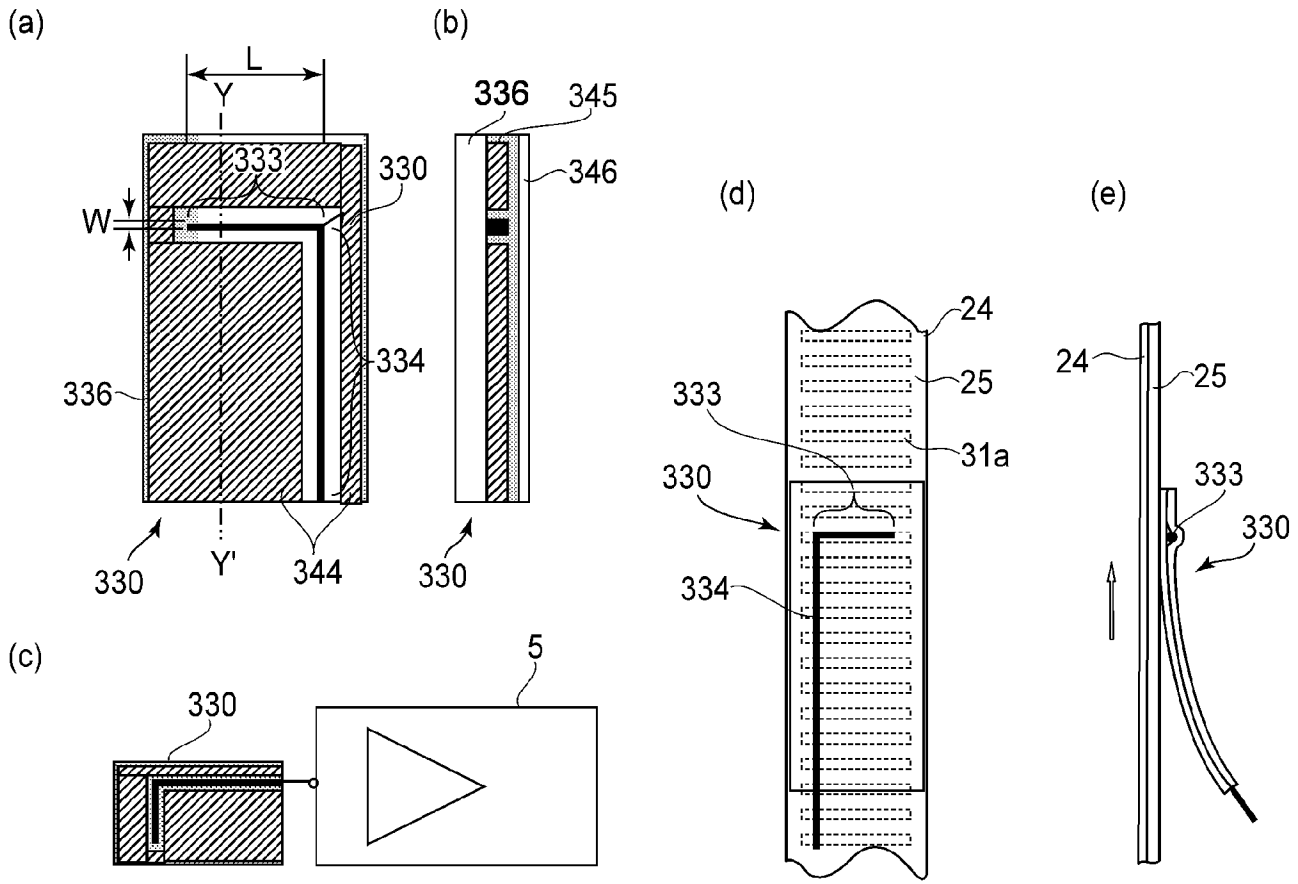

Parts (*a*) to (*d*) of FIG. 4 are illustrations of an antenna potential sensor.

Figure 5:
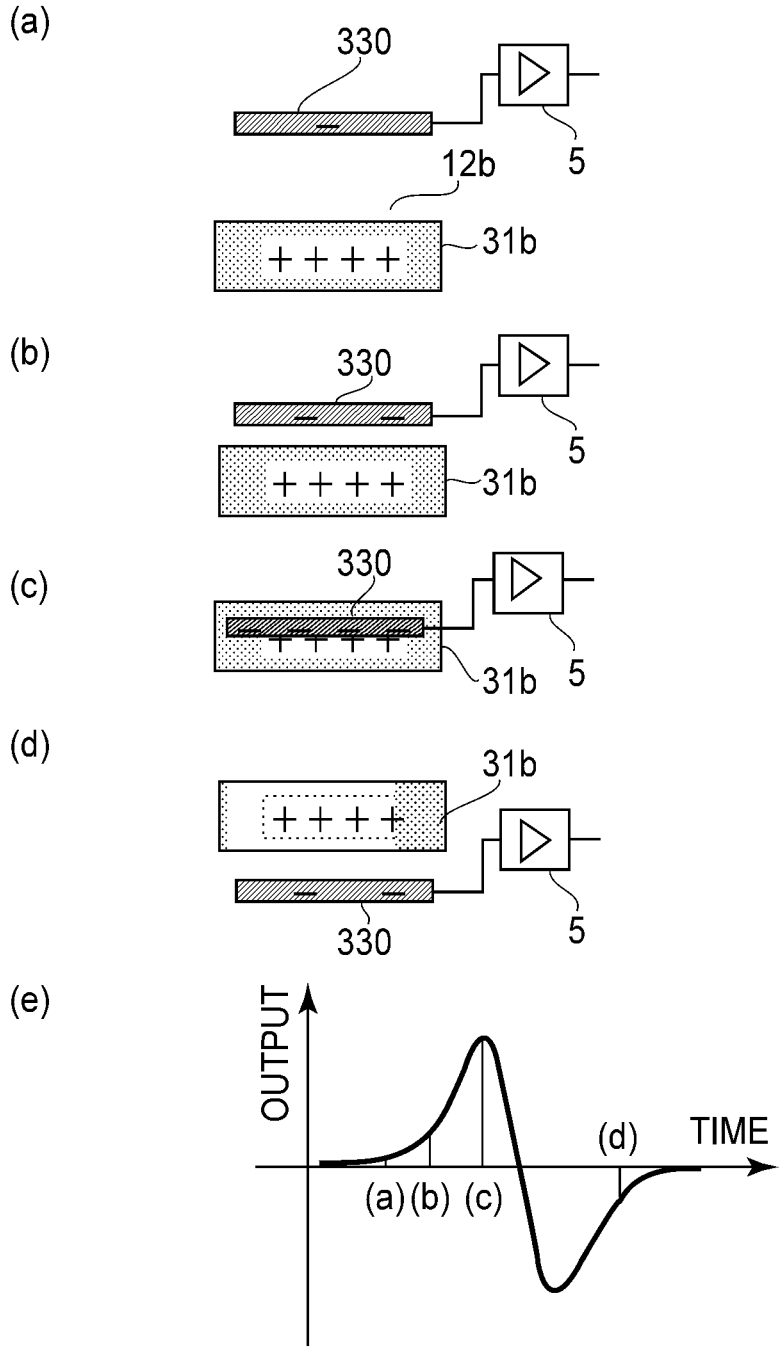

Parts (*a*) to (*d*) of FIG. 5 are illustrations of detection of the electrostatic image code by the antenna potential sensor.

Figure 6:
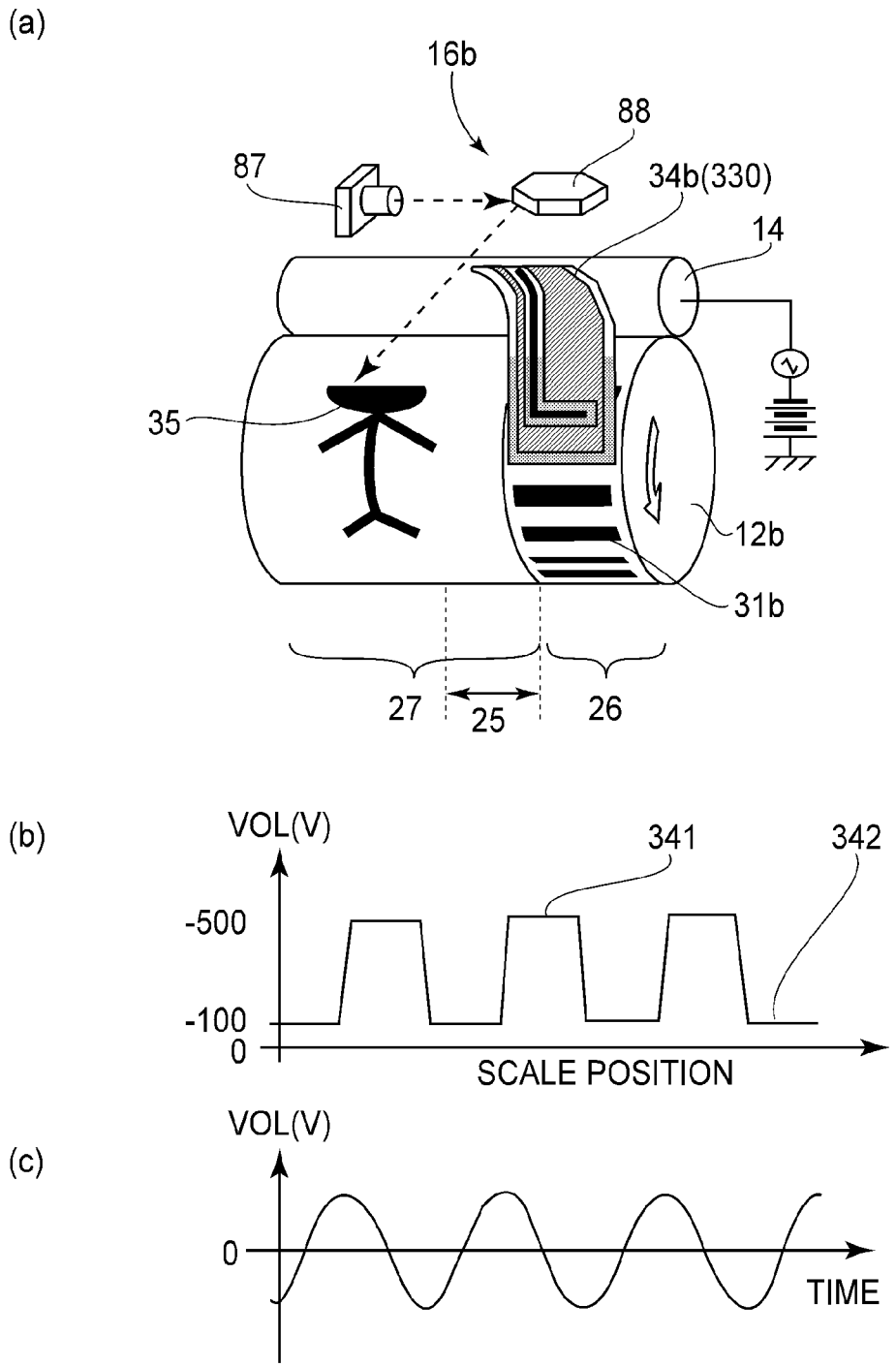

Parts (*a*) to (*c*) of FIG. 6 are illustrations of registration (alignment) control of toner images by using the electrostatic image code.

Figure 7:
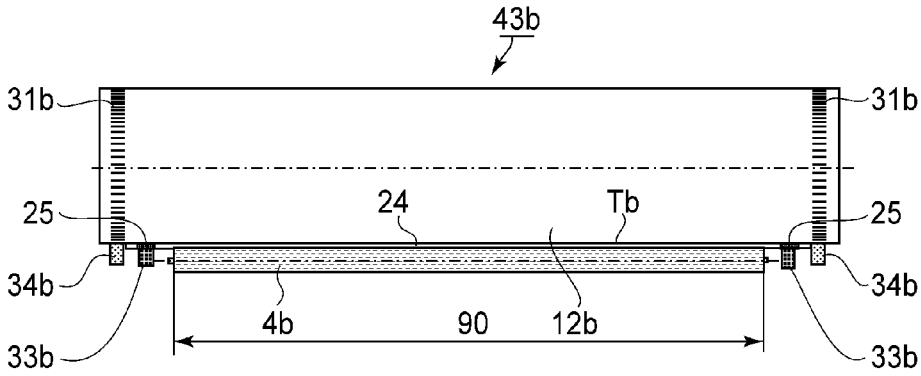

FIG. 7 is an enlarged view of a primary transfer portion of a magenta image forming portion.

Figure 8:
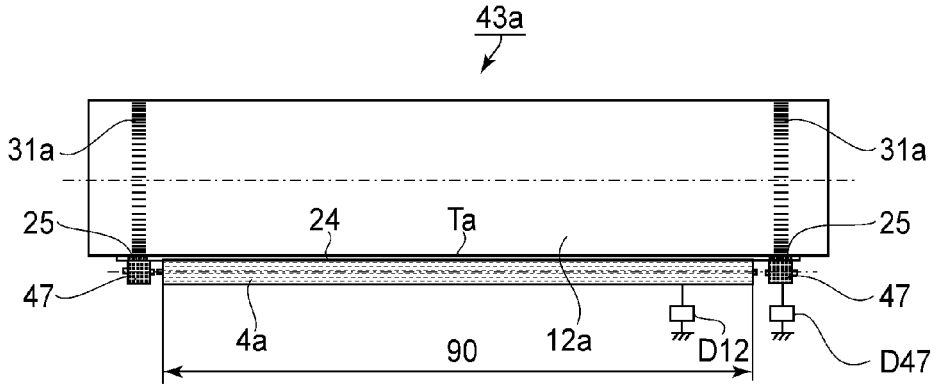

FIG. 8 is an illustration of a constitution of a toner portion of a yellow image forming portion in a comparative embodiment.

Figure 9:
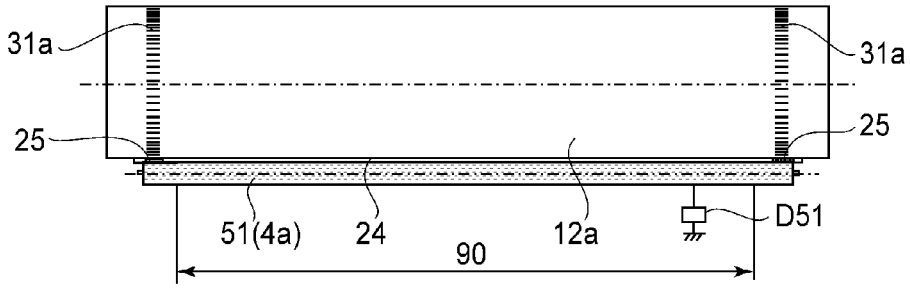

FIG. 9 is an illustration of a constitution of a toner portion of a yellow image forming portion.

Figure 10:
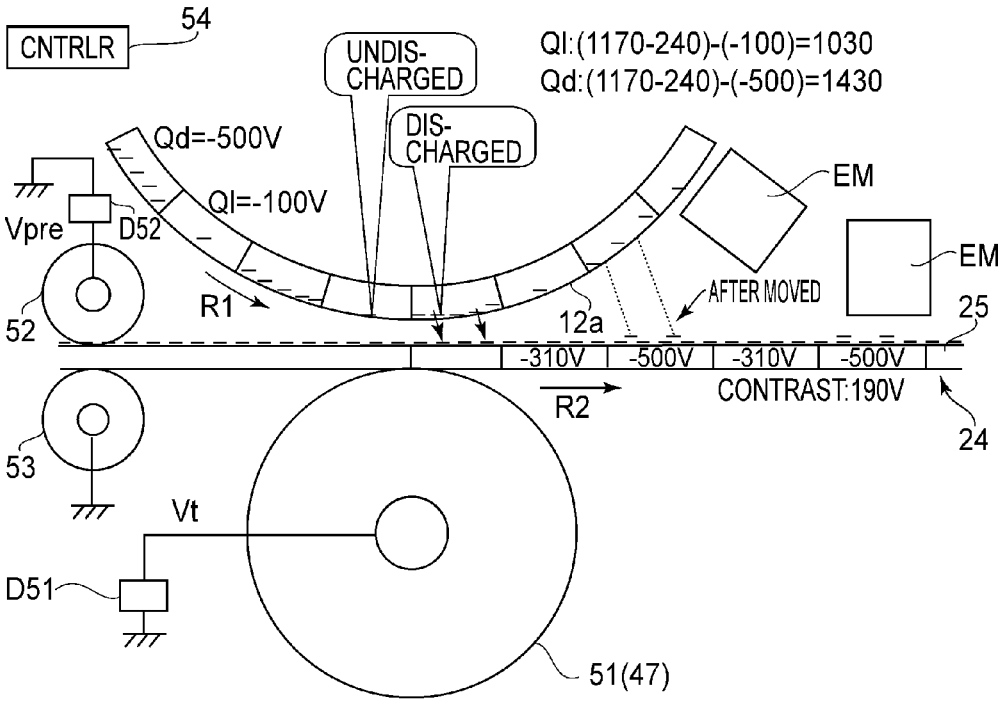

FIG. 10 is an illustration of control for obtaining a transfer voltage adapted to transfer of the electrostatic image code.

Figure 11:
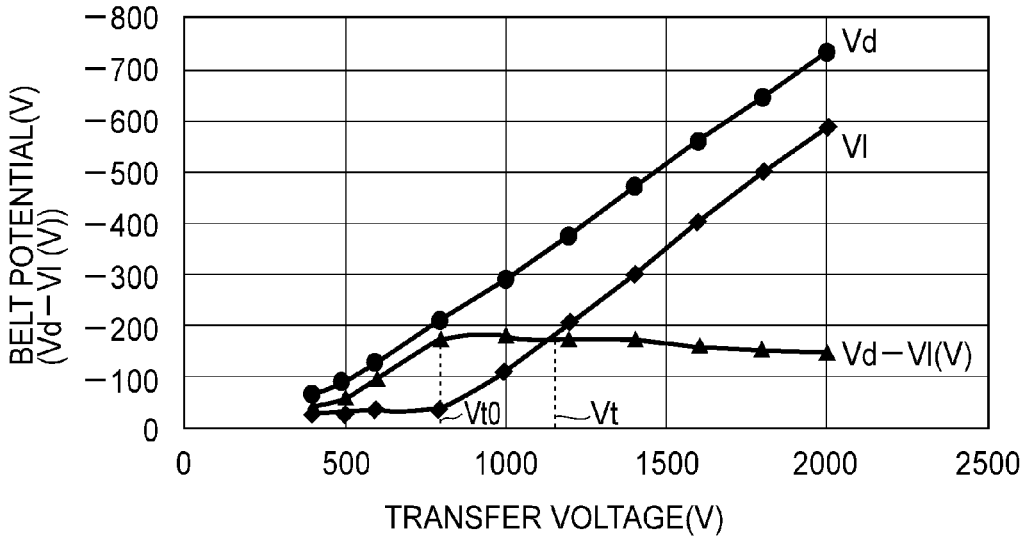

FIG. 11 is a graph for illustrating a relationship between an electrostatic image contrast of an electrostatic image pattern transferred onto an intermediary transfer belt, and a transfer voltage.

Figure 12:
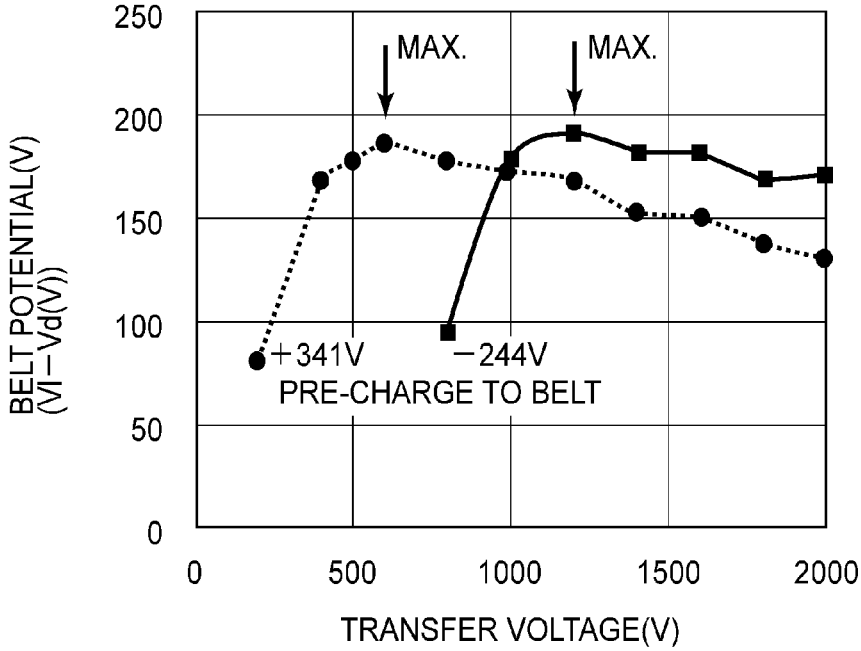

FIG. 12 is an illustration of an effect of pre-charging.

Figure 13:
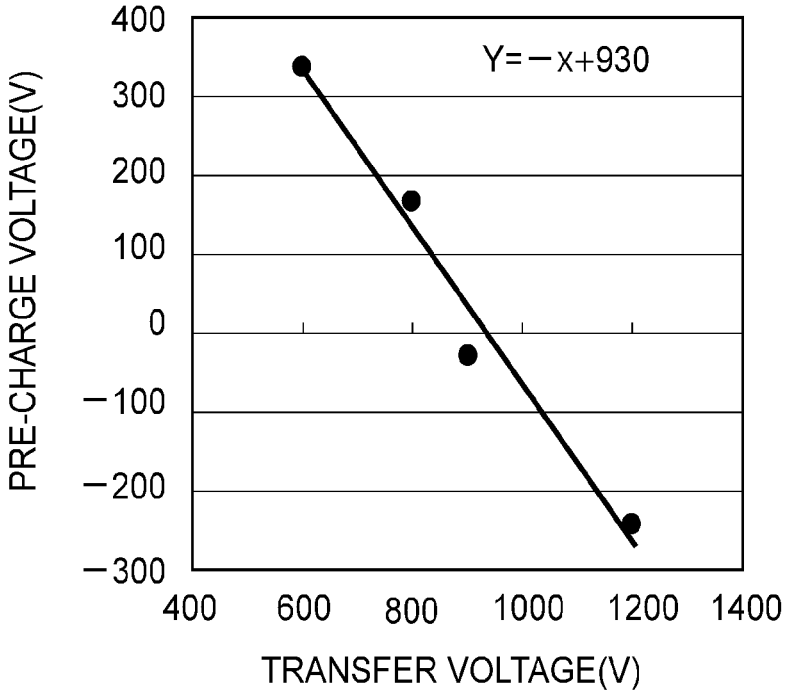

FIG. 13 is a graph for illustrating a relationship between an optimum contact voltage for electrostatic image transfer and the transfer voltage.

Figure 14:
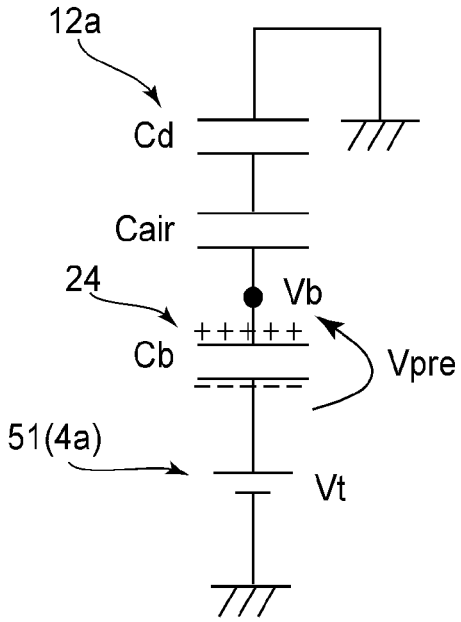

FIG. 14 is an equivalent circuit of a transfer portion in transfer of the electrostatic image with the pre-charging.

Figure 15:
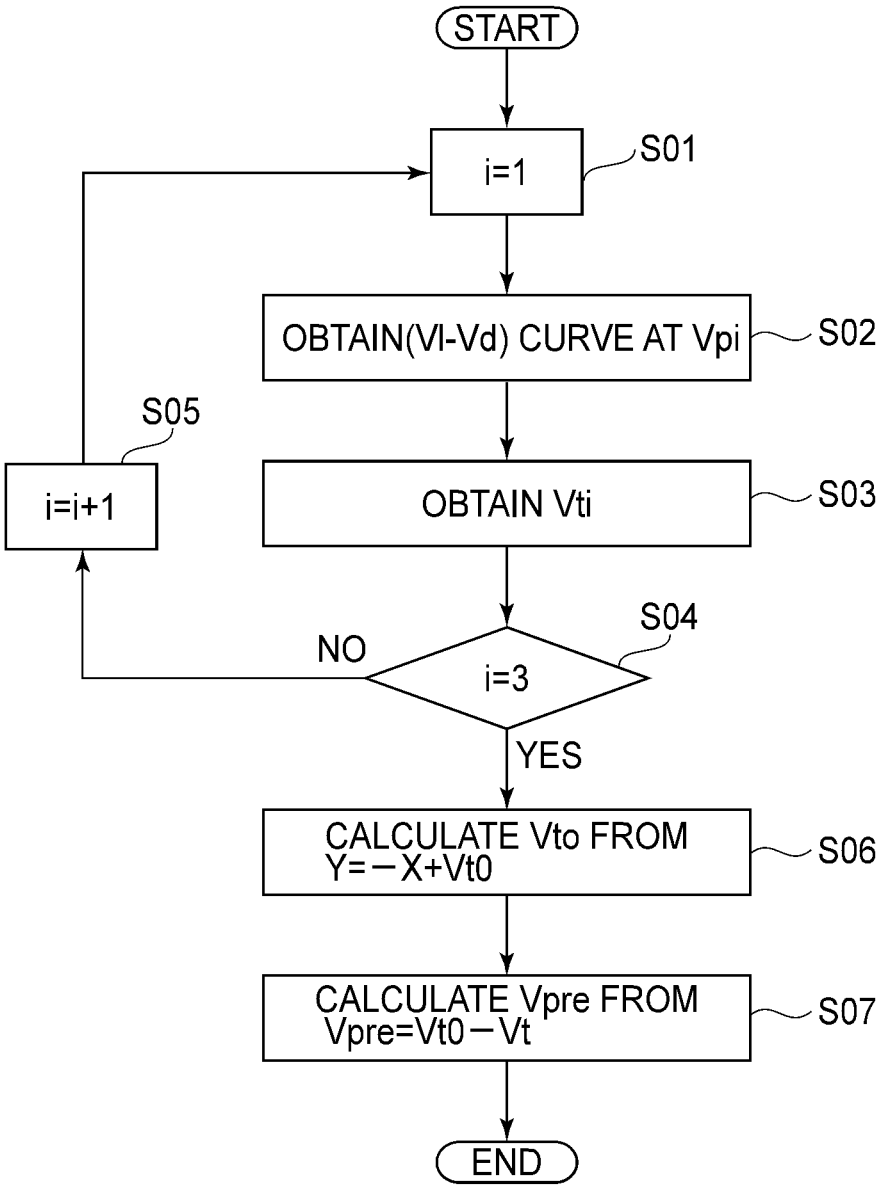
Figure 16:
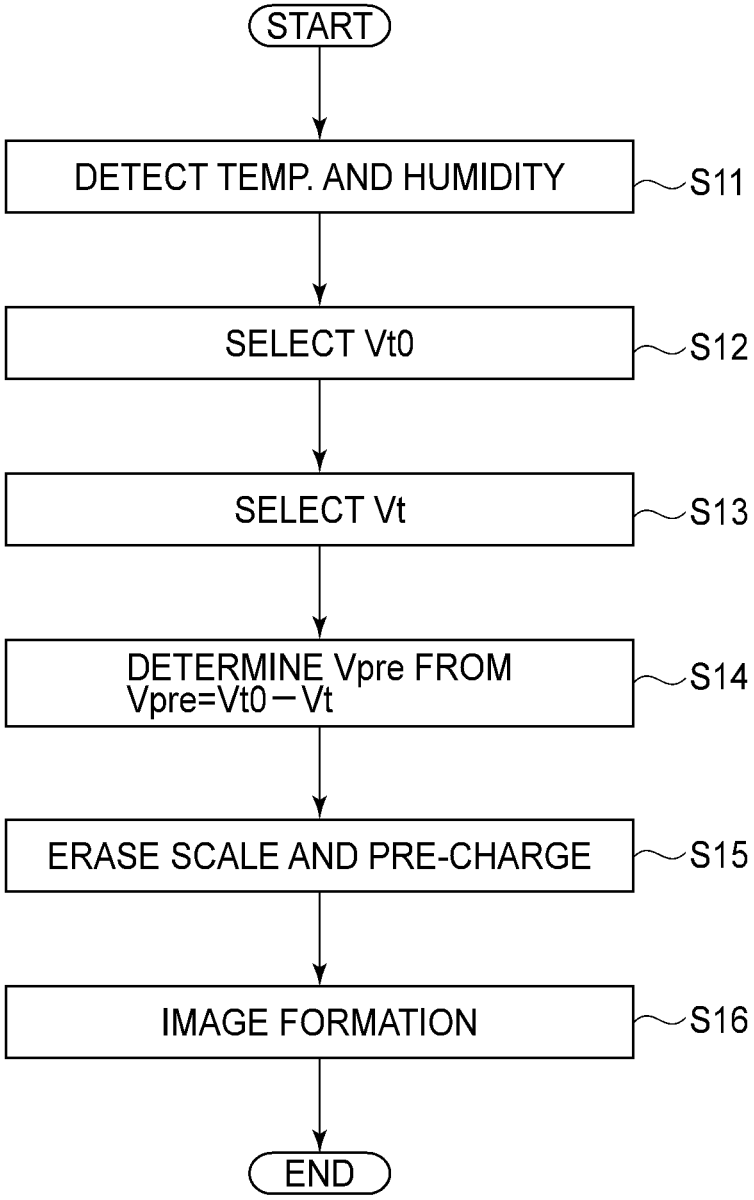

FIGS. 15 and 16 are flow charts of pre-charging control in Embodiments 2 and 3, respectively.

Figure 17:
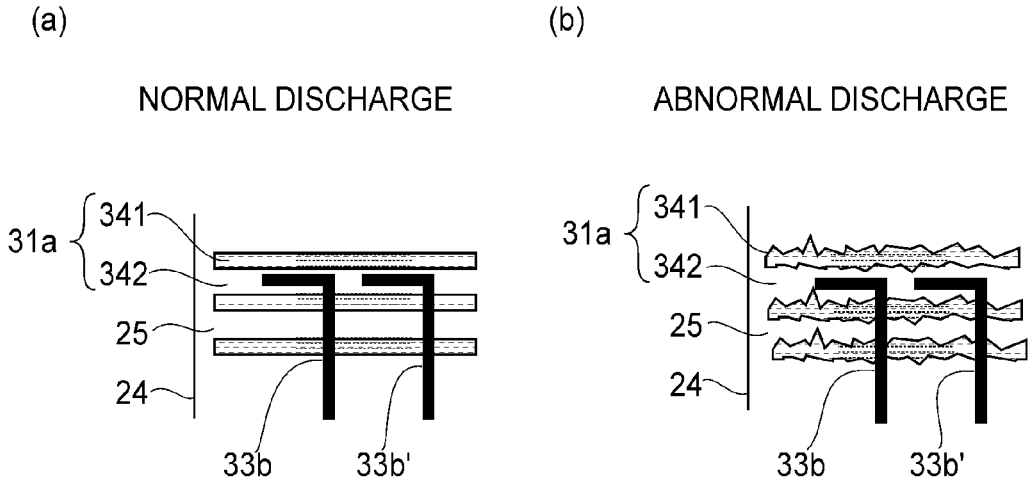

Parts (*a*) and (*b*) of FIG. 17 are illustrations of evaluation of the electrostatic image code transferred onto the intermediary transfer belt.

Figure 18:
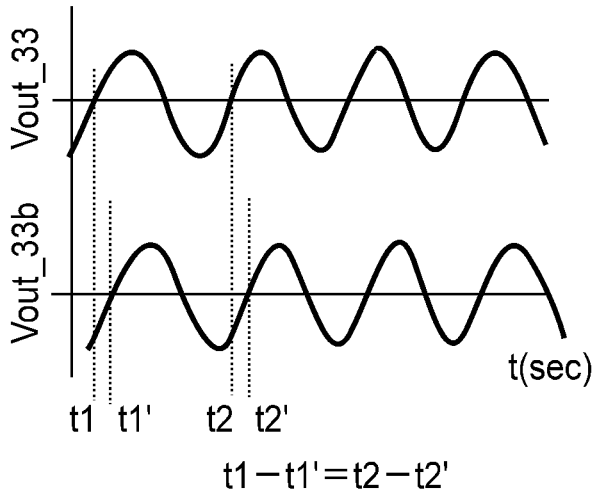
Figure 18:
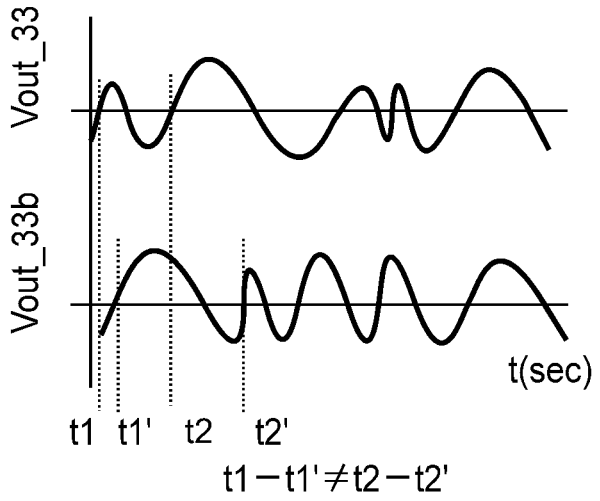

Parts (*a*) and (*b*) of FIG. 18 are illustrations of a change in detection signal of the antenna potential sensor.

FIGS. 19, 20, 21 and 22 are flow charts of pre-charging control in Embodiments 4, 5, 6 and 7, respectively.

DESCRIPTION OF THE PREFERRED EMBODIMENTS

Embodiments of the present invention will be described specifically with reference to the drawings. The present invention can also be carried out in other embodiments in which a part or all of constituent elements are replaced with their alternative constituent elements so long as an electrostatic image transfer area of a belt member is electrically charged to a potential different from a potential of a toner image transfer area.

Therefore, the present invention can be carried out irrespective of the number of image bearing members, a difference of intermediary transfer type/recording material conveyance type, a charging type of the image bearing members, an electrostatic image forming method, a developer and a developing method, a transfer method, and the like.

Further, in this embodiment, only a principal part relating to toner image formation and transfer will be described but the present invention can be carried out by image forming apparatuses for various purposes such as printers, various printing machines, copying machines, facsimile machines and multi-function machines by adding necessary device, equipment and casing structure.

<Image Forming Apparatus>

Figure 1:
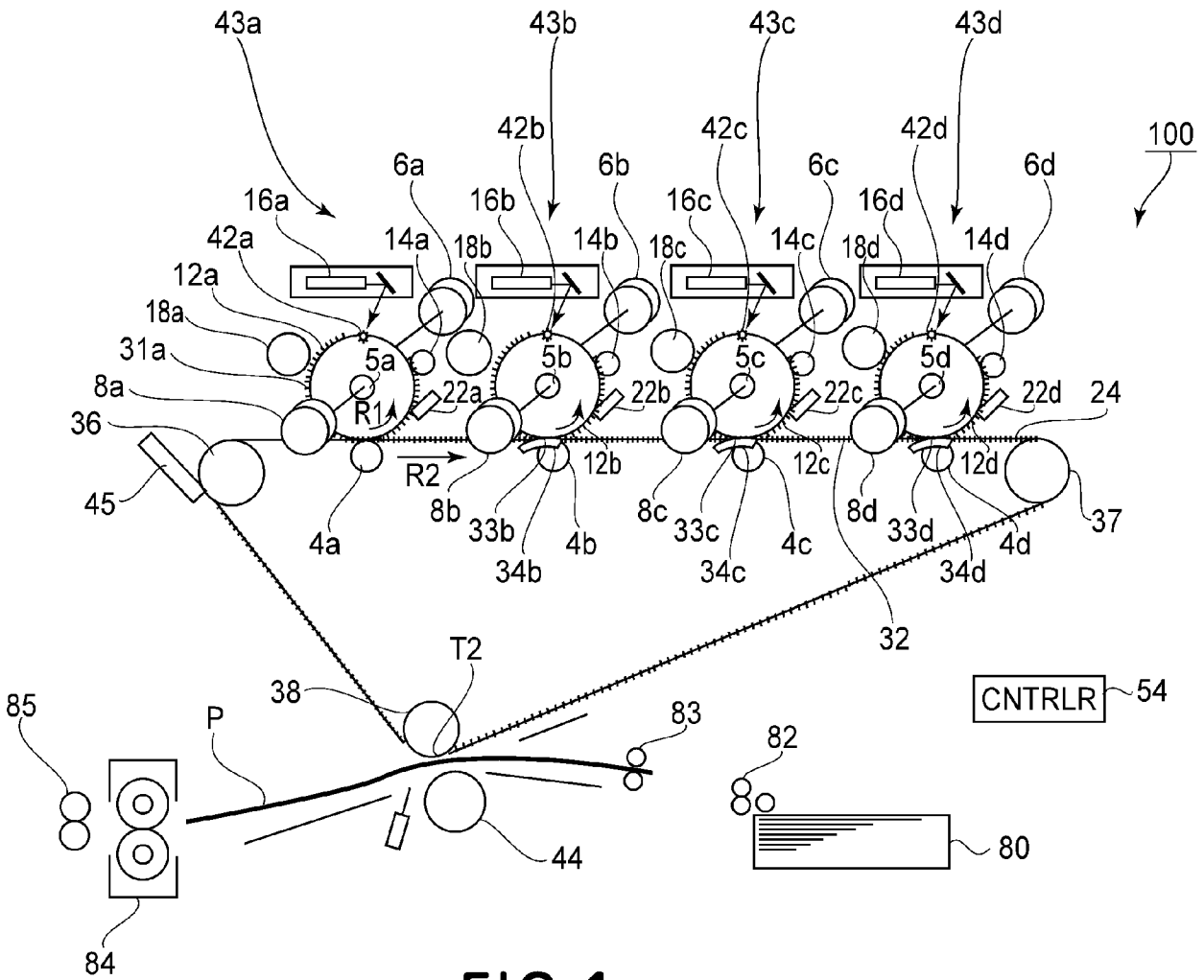
FIG. 1 is an illustration of a general structure of an image forming apparatus.
Figure 2:
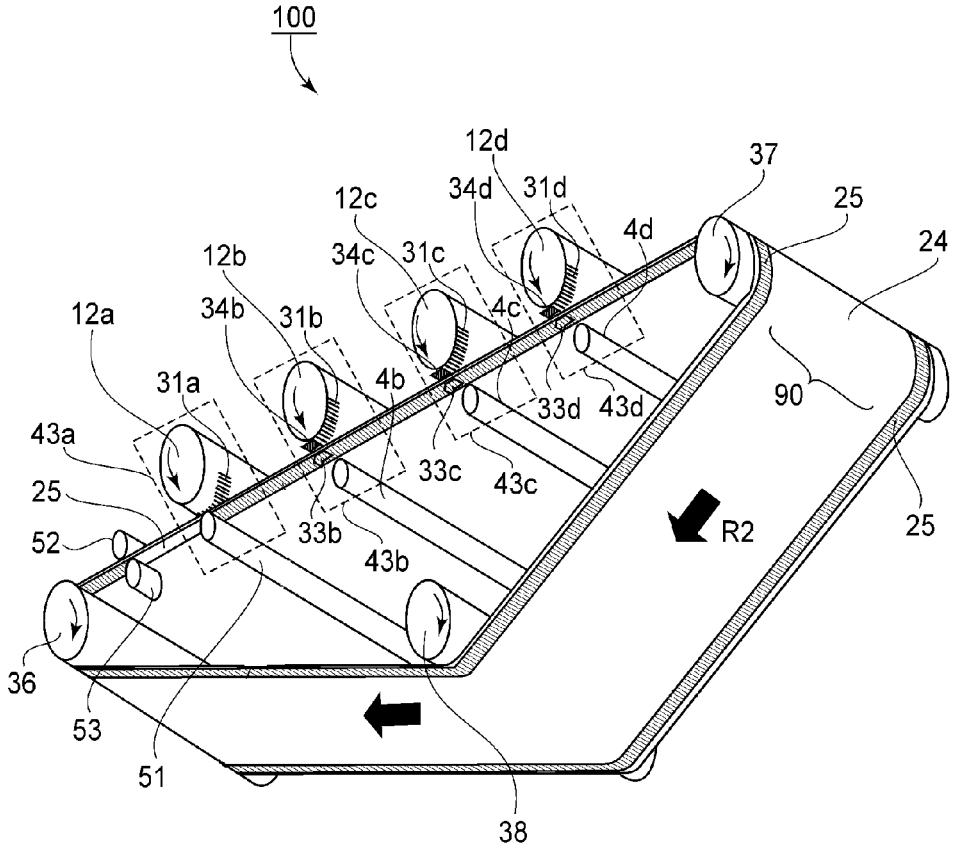
FIG. 2 is an illustration of an arrangement of electrostatic image transfer areas and potential sensors.

FIG. 1 is an illustration of a general structure of the image forming apparatus. FIG. 2 is an illustration of an arrangement of an electrostatic image transfer area and a potential sensor.

As shown in FIG. 1, the image forming apparatus 100 is a full-color printer of the tandem type and of the intermediary transfer type, in which yellow, magenta, cyan and black image forming portions 43*a*, 43*b*, 43*c* and 43*d*, respectively, are arranged along an intermediary transfer belt 24.

In the image forming portion 43*a*, a yellow toner image is formed on a photosensitive drum 12*a*, and is transferred onto the intermediary transfer belt 24. In the image forming portion 43*b*, a magenta toner image is formed on a photosensitive drum 12*b*, and is transferred onto the intermediary transfer belt 24. In the image forming portions 43*c* and 43*d*, cyan and black toner images are formed on photosensitive drums 12*c* and 12*d*, respectively, and are transferred onto the intermediary transfer belt 24. After being transferred onto the intermediary transfer belt 24, the four toner images are conveyed to a second transfer portion T2 and then are secondary-transferred onto a recording material P.

The recording material P pulled out of a recording material cassette 80 is separated one by one by a separation roller 82 and then is conveyed to a registration roller 83, by which the recording material P is sent to a secondary transfer portion T2.

Then, in a process in which the recording material is conveyed through the secondary transfer portion T2, a positive voltage is applied to a secondary transfer roller 44, whereby the toner images are secondary-transferred from the intermediary transfer belt 24 onto the recording material P. The recording material P on which the toner images are secondary-transferred is conveyed to a fixing device 84. In the fixing device 84, the recording material P is subjected to heat and pressure, whereby the toner images are fixed and thereafter the recording material P is discharged to the outside of the image forming apparatus 100 by a discharging roller 85.

The image forming portions 43*a*, 43*b*, 43*c* and 43*d* have the same constitution except that the colors of the developers used by their developing apparatuses 18*a*, 18*b*, 18*c* and 18*d* are different from each other. In the following, the image forming portion 43*a* will be described. As for the image forming portions 43*b*, 43*c* and 43*d*, their descriptions are the same as the description of the image forming portion 43*a* except that the suffix "a" of reference numerals or symbols of constituent members of the image forming portion 43*a* is replaced with b, c and d, respectively.

The image forming portion 43*a* (43*b*, 43*c*, 43*d*) includes a charging roller 14*a* (14*b*, 14*c*, 14*d*), an exposure device 16*a*

(16*b*, 16*c*, 16*d*), a developing device 18*a* (18*b*, 18*c*, 18*d*), a primary transfer roller 4*a* (4*b*, 4*c*, 4*d*), and a drum cleaning device 22*a* (22*b*, 22*c*, 22*d*), which are disposed at the periphery of the photosensitive drum 12*a* (12*b*, 12*c*, 12*d*).

The photosensitive drum 12*a* is prepared by forming an OPC (organic photoconductor) photosensitive layer having a negative charge polarity on an outer peripheral surface of an aluminum cylinder and is rotated in a direction indicated by an arrow R1 at a predetermined process speed. The charging roller 14*a* is supplied with a charging voltage in the form of a DC voltage biased with an AC voltage, so that the surface of the photosensitive drum 12*a* to a uniform negative dark-portion potential VD.

The exposure device 16*a* (16*b*, 16*c*, 16*d*) effects scanning exposure with a laser beam through a rotating mirror to a location 42*a* (42*b*, 42*c*, 42*d*) on photosensitive drum 12*a* (12*b*, 12*c*, 12*d*), so that the surface potential of the photosensitive drum 12*a* is lowered to a light-portion potential VL and thus the exposure device 16*a* writes the electrostatic image for the image on the photosensitive drum 12*a*. The developing device 18*a* develops the electrostatic image with a two-component developer containing a toner and a carrier, thus forming the toner image on the photosensitive drum 12*a*. At the exposed portion of the light-portion potential Vl, the yellow toner is deposited and the electrostatic image is reversely developed into the yellow toner image.

The primary transfer roller 4*a* urges the inner surface of the intermediary transfer belt 24 to form the primary transfer portion between the photosensitive drum 12*a* and the intermediary transfer belt 24. By applying a positive DC voltage to the primary transfer roller 4*a*, the toner image is primary-transferred from the photosensitive drum 12*a* onto the intermediary transfer belt 24.

The drum cleaning device 22*a* slides a cleaning blade on the surface of the photosensitive drum 12*a* to collect transfer residual toner remaining on the surface of the photosensitive drum 12*a* without being transferred onto the intermediary transfer belt 24. A belt cleaning device 45 slides a cleaning blade on the surface of the intermediary transfer belt 24, supported by a driving roller 36 at the inner surface of the intermediary transfer belt 24, to collect from the surface of the intermediary transfer belt 24 the transfer residual toner passing through the secondary transfer portion T2.

As shown in FIG. 2, the intermediary transfer belt 24 is stretched by a tension roller 37, the driving roller 36 and an opposite roller 38, and by the tension roller 37, a predetermined tension is applied to the intermediary transfer belt 24. The driving roller 36 is rotationally driven by an unshown driving motor to rotate the intermediary transfer belt 24 in an arrow R2 direction at a predetermined process speed.

The intermediary transfer belt 24 is a polyimide-based belt adjusted at a volume resistivity of $1\times10^{10}$ Ω.cm by incorporating carbon (black) particles, and a toner image transfer area is provided at a widthwise central portion of the intermediary transfer belt 24.

An electrostatic image transfer area 25 is formed by laminating a resinous film of PET, PTFE, polyimide or the like having a volume resistivity of $1\times10^{5}$ Ω.cm or more on the surface of the intermediary transfer belt 24 at widthwise end portions of the intermediary transfer belt 24. However, the material for the electrostatic image transfer area 25 is not limited to these materials if the material is a high-resistance material which can be formed on the intermediary transfer belt 24.

<Electrostatic Image for Alignment>

Incidentally, a problem of the tandem type image forming apparatus in which the plurality of image forming portions are arranged along the intermediary transfer belt is that the plurality of photosensitive drums and the intermediary transfer belt cause a fluctuation in speed. At transfer portions of the plurality of photosensitive drums, a fluctuation in relative speed between each photosensitive drum outer peripheral surface and the intermediary transfer belt surface occurs separately and when the respective color toner images are superposed, color misregistration of 100-150 μm can occur.

In the image forming apparatus described in JP-A Hei 10-39571, an electrostatic image patch formed on the upstream photosensitive drum is transferred onto the recording material conveyer belt and then is detected at the transfer portion of the downstream photosensitive drum. In this case, the electrostatic image patch is transferred onto the recording material conveyer belt before image formation or after the image formation is interrupted, and then is used for adjusting writing timing of the electrostatic image for the image on the downstream photosensitive drum.

For this reason, during the image formation, data for correcting positional deviation cannot be obtained in real time, so that the positional deviation correction of the respective color toner images during the image formation on one sheet cannot be completed in real time. The peripheral speed fluctuation of the photosensitive drums and the driving roller or a periodical color misregistration of the color toner images occurring with a short period due to expansion and contraction of the intermediary transfer belt were not intended to be corrected and an effect of the correction could not be expected.

In the image forming apparatus described in JP-A 2004-145007, correction of an image position is made in real time while effecting the image formation on one sheet, so that the periodical speed fluctuation of the photosensitive drum or the intermediary transfer belt with a short period can be corrected. In this case, mode (scale) information transcribed from an upstreammost photosensitive drum is read at the toner portion of a downstream photosensitive drum, so that the momentary rotational speed of the downstream photosensitive drum is changed in real time.

However, the writing of the code information on the intermediary transfer belt is made by using a magnetic recording method and therefore synchronism deviation occurs between the toner image for the image transferred on the intermediary transfer belt and the transcribed code information. By the influence of exposure position determination accuracy of the exposure device with respect to the exposure position and the influence of expansion and contraction of parts due to the temperature, a fluctuation of the exposure device itself of several tens of μm occurs. Each of a reading error and a writing error when the code information on the photosensitive drum is read and then is transcribed on the intermediary transfer belt also occurs in an amount of several tens of μm. Further, relative positional alignment error among the plurality of photosensitive drums occurs in an amount of several tens of μm. For these reasons, due to these errors, it was difficult to suppress the positional deviation of each of the toner images for the respective color images at a level of 100 μm or less.

Therefore, as shown in FIG. 2, in the image forming apparatus 100, in order to suppress the positional deviation of each color image at the level of 100 μm or less, the electrostatic image code (scale) 31*a* formed on the photosensitive drum 12*a* in synchronism with the electrostatic image for the image is transferred as it is onto the intermediary transfer belt 24. The transfer of the electrostatic image code 31*a* onto the electrostatic image transfer area 25 is performed simultaneously with the primary transfer of the toner image for the image onto the intermediary transfer belt 24.

Then, in the downstream image forming portion 43*b*, the electrostatic image code 31*a* transferred on the electrostatic image transfer area 25 is read by a belt code reading sensor 33*b* (first detecting portion), so that the above-described periodical positional deviation of the toner image for each color image is corrected in real time and with high accuracy.

On the upstream photosensitive drum 12*a*, the electrostatic image code 31*a* is formed in synchronism with the scanning lines for the yellow toner image. The yellow toner image is primary-transferred onto a central toner image transfer area 90 of the intermediary transfer belt 24, and the electrostatic image code 31*a* is transferred onto the electrostatic image transfer area 25 laminated on the intermediary transfer belt 24 at each of widthwise end portions of the intermediary transfer belt 24. The electrostatic image transfer area 25 has a higher resistance than that of the toner image transfer area 90 of the intermediary transfer belt 24 and therefore the electrostatic image code 31*a* transferred on the electrostatic image transfer area 25 reaches the image forming portions 43*b*, 43*c* and 43*d* without being attenuated and is detectable with high accuracy.

The electrostatic image code 31*a* transferred from the photosensitive drum 12*a* on the electrostatic image transfer area 25 is detected at the position of the photosensitive drum 12*b* and is used for positional alignment of the toner images with respect to the conveyance direction. The electrostatic image code 31*a* transferred on the outer surface of the intermediary transfer belt 24 is detected by the belt code reading sensor 33*b* from the inner surface of the intermediary transfer belt 24 at the outside of the primary transfer roller 4*a* with respect to the longitudinal direction of the primary transfer roller 4*a*.

On the photosensitive drum 12*b*, an electrostatic image code 31*b* is formed at an area 26 in synchronism with the scanning lines of the electrostatic image for the magenta image. The toner image for the magenta image is primary-transferred superposedly into the toner image for the yellow image in the toner image transfer area 90 of the intermediary transfer belt 24. At the same time, the electrostatic image code 31*b* of the photosensitive drum 12*b* is detected by a drum code reading sensor 34*b* (second detecting portion) at the widthwise outside of the intermediary transfer belt 24. Further, in this embodiment, an adjusting means (controller 54) adjusts a condition (operation) for forming the electrostatic image on the photosensitive drum 12*b* so that the electrostatic image code detected by the belt code reading sensor 33*b* and the electrostatic image code detected by the drum code reading sensor 34*b* coincide with each other. As an example thereof, a constitution for adjusting the exposure timing may be used.

<Antenna Potential Sensor>

Figure 3:
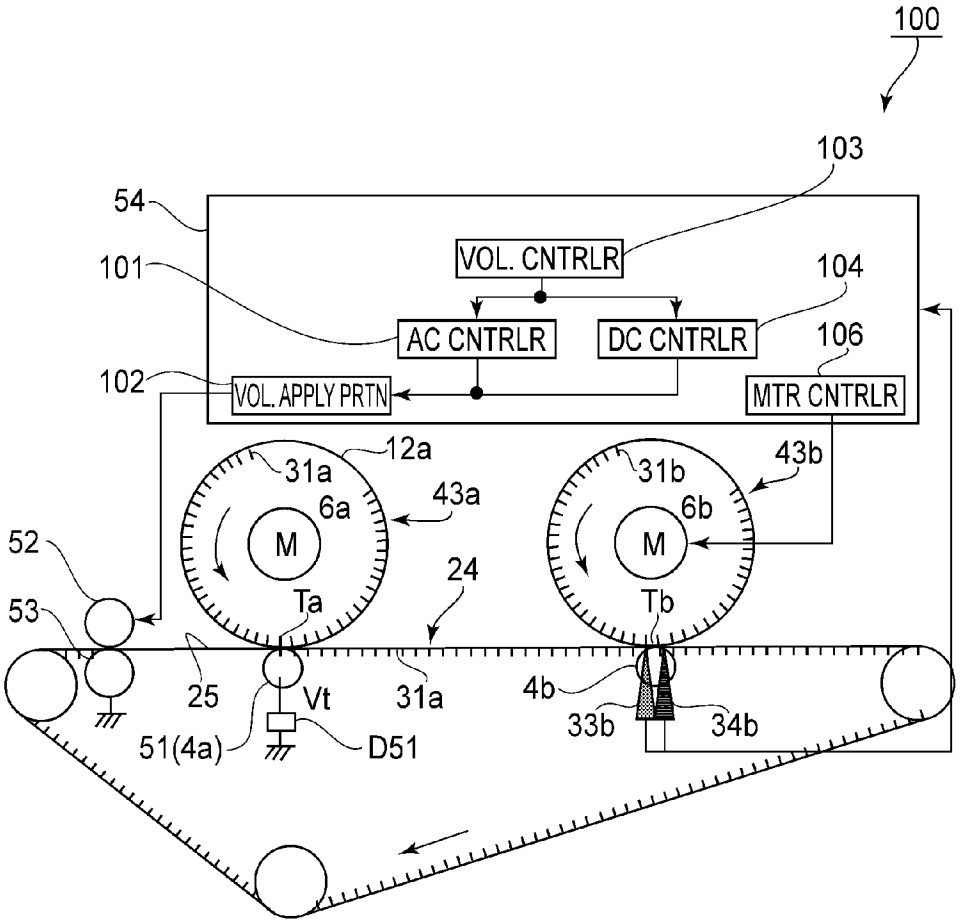
FIG. 3 is an illustration of detecting of an electrostatic image code transferred onto an intermediary transfer belt.

FIG. 3 is an illustration of detecting of an electrostatic image code transferred onto an intermediary transfer belt. Parts (*a*) to (*d*) of FIG. 4 are illustrations of an antenna potential sensor. Parts (*a*) to (*d*) of FIG. 5 are illustrations of detection of the electrostatic image code by the antenna potential sensor. Parts (*a*) to (*c*) of FIG. 6 are illustrations of registration (alignment) control of toner images by using the electrostatic image code. FIG. 7 is an enlarged view of a primary transfer portion of a magenta image forming portion.

As shown in FIG. 1, to the photosensitive drum 12*a* (12*b*, 12*c*, 12*d*), a driving force is transmitted from a rear drum driving motor 6*a* (6*b*, 6*c*, 6*d*) and at a front side, a drum encoder 8*a* (8*b*, 8*c*, 8*d*) for detecting the rotational speed every moment is connected at shaft 5*a* (5*b*, 5*c*, 5*d*). On the basis of an output signal of the drum encoder 8*a*, the drum driving motor 6*a* is controlled, so that the photosensitive drum 12*a* is driven by the drum driving motor 12*a* to rotate at the same angular speed.

As shown in FIG. 3, a motor driving portion 106 controls the rotational speed of the drum driving motor 6*b* in real time so that an output signal of the belt code reading sensor 33*b* and an output signal of the drum code reading sensor 34*b* are phase-aligned with each other. As a result, with the yellow toner image first transferred on the intermediary transfer belt 24, the magenta toner image carried on the photosensitive drum 12*b* is positionally aligned at a scanning-line level.

Also with respect to the photosensitive drums 12*c* and 12*d*, similarly as in the case of the photosensitive drum 12*b*, the alignment of the cyan toner image and the black toner image is similarly executed by controlling drum driving motors 6*c* and 6*d*, respectively.

Incidentally, in FIG. 3, for convenience of illustration, the phase positions of the belt code reading sensor 33*b* and the drum code reading sensor 34*b* are shifted but as described above, they are disposed in an overlapping manner at the positions corresponding to the primary transfer portion Tb of the photosensitive drum 12*b*.

As each of the drum code sensors 34*b* (second detecting portion), 34*c* (third detecting portion) and 34*d* (fourth detecting portion) and the belt code reading sensors 33*b* (first detecting portion), 33*c* (fifth detecting portion) and 33*d* (sixth detecting portion), an antenna potential sensor 330 shown in FIG. 4 is used. As shown in FIG. 4, the antenna potential sensor (electrostatic image detecting probe) 330 was prepared. In FIG. 4, (*a*) is a plan view and (*b*) is a sectional view taken along Y-Y' plane (line) of (*a*).

As shown in (*a*) of FIG. 4, a horizontal portion 333 of the antenna potential sensor 330 performs the function of detecting the electrostatic image code 31*b*. A vertical portion 334 of the antenna potential sensor 330 performs the function of deriving a current detected by the horizontal portion 333. The antenna potential sensor 330 is prepared in the following manner.

(1) As shown in (*a*) of FIG. 4, on a 15 μm-thick flexible print substrate (film) 336 of polyimide which is generally used for internal wiring of electric appliances, an electrode layer is formed.

(2) As shown in (*a*) of FIG. 4, an L-shaped pattern including the vertical portion 334 and the horizontal portion 333 (having a width W and a length L) is formed from the electrode by wet etching.

(3) As shown in (*b*) of FIG. 4, a polyimide cover film 346 (thickness: 15 μm) is applied via an adhesive layer 345 (thickness: 15 μm) for preventing abrasion (wearing).

(4) As shown in (*c*) of FIG. 4, an end portion of the antenna potential sensor 330 is connected to an amplifier circuit 5 via an unshown connector.

Part (*d*) of FIG. 4 shows a detection state and (*e*) of FIG. 4 shows a contact state.

As shown in (*a*) of FIG. 5, the electrostatic image code 31*b* is present as a potential difference pattern on the surface of the photosensitive drum 12*b*. The antenna potential sensor 330 timewise moves relative to the electrostatic image code 31*b* in the order of (*a*), (*b*), (*c*) and (*d*) of FIG. 5.

The antenna potential sensor 330 is provided at a position slightly spaced (several μm to several tens of μm) from the surface of the photosensitive drum 12*b* in a direction perpendicular to the drawing sheet and moves during relative movement while keeping a constant distance from the surface of the photosensitive drum 12*b*. The electrostatic image code 31*b* is arranged in a code (scale)-like shape in a direction of the relative movement to the antenna potential sensor 330 but in FIG. 5, only a single (one) electrostatic image code is shown. Further, the potential of the electrostatic image code 31*b* is indicated as positive (+). This is because the case where an adjacent portion is charged to the dark-portion potential VD of −500 V and the electrostatic image code 31*b* is charged to the light-portion potential VL of −100 V is assumed.

An output line of the antenna potential sensor 330 is connected to the amplifier circuit 5. The antenna potential sensor 330 detects the single electrostatic image code 31*b* by outputting induced currents flowing in opposite directions in a process in which the antenna potential sensor 330 approaches a center line of the electrostatic image code 31*b* and in a process in which the antenna potential sensor 330 is moved away from the center line.

As shown in (*a*) of FIG. 5, when the antenna sensor 330 approaches the electrostatic image code 31*b*, free electrons of the antenna potential sensor 330 and the amplifier circuit 5 are slightly attracted to the positive potential of the electrostatic image code 31*b*.

As shown in (*b*) of FIG. 5, the antenna potential sensor 330 further approaches the electrostatic image code 31*b*, so that the amount of the attracted free electrons is increased.

As shown in (*c*) of FIG. 5, the antenna potential sensor 330 is closest to the electrostatic image code 31*b*, so that the amount of the attracted free electrons is maximum.

As shown in (*d*) of FIG. 5, finally, when the antenna potential sensor 330 starts to move away from the electrostatic image code 31*b*, the attracted free electrons start to be returned.

As shown in (*e*) of FIG. 5, the flowing states of the free electrons (induced currents) as shown in (*a*) to (*d*) of FIG. 5 are detected and amplified by the amplifier (electric) circuit 5, so that the position of the electrostatic image code 31*b* can be derived as an electric signal. An output is increased as the antenna potential sensor 330 approaches the electrostatic image code 31*b*, and when the antenna potential sensor 330 overlaps with (i.e., is closest to) the electrostatic image code 31*b*, the induced current instantaneously becomes zero. Then, as the antenna potential sensor 330 is moved away from the electrostatic image code 31*b*, a negative output is obtained, but as the distance from the electrostatic image code 31*b* is increased, the output signal becomes zero. The above is a principle of the detection of the electrostatic image code 31*b*.

As shown in (*a*) of FIG. 6, on the photosensitive drum 12*b*, the electrostatic image code 31*b* and the electrostatic image 35 for the image are formed simultaneously by using an exposure device 16*b*. Outside the electrostatic image for the image, an operation in which n scanning lines are continuously subjected to light exposure and then the light exposure of the n scanning lines is stopped is repeated.

A cycle (period) of the electrostatic image code 31*b* can have various lengths depending on a resolution of the exposure device 16*b* and the rotational speed of the photosensitive drum 12*b*. For example, when the resolution is 600 dpi, a scanning line width is about 42 μm and therefore in the case where the electrostatic image code 31*b* with 4 lines/4 spaces in which the exposed portion corresponding to 3 lines and the unexposed portion corresponding to 4 lines are repeated is assumed, the cycle of the electrostatic image code 31*b* is 336 μm which is 8 times the scanning line width of 42 μm.

As shown in (*b*) of FIG. 6, an incremental pattern of the dark-portion potential VD (unexposed) and the light-portion potential VL (exposed) is formed on the photosensitive drum 12*b* at a duty of 50%. The surface potential of the photosensitive drum 12*a* is the same as the potential of an image area 27 and in the electrostatic image code 31*b*, e.g., a rectangular wave of an unexposed portion 341 of −500 V and an exposed portion 342 of −100 V is obtained.

When the rectangular surface potential pattern is detected by the antenna potential sensor 330, as shown in (*c*) of FIG. 6, a sine waveform having an amplitude with zero volts as the center is obtained. By adjusting a combination of the cycle of the incremental pattern, circuit impedance, the rotational speed and the like, the differential waveform shown in (*e*) of FIG. 5 can be rectified as the sine output waveform.

Also with respect to the electrostatic image code 31*a* formed on the photosensitive drum 12*a* and then transferred on the intermediary transfer belt 24, a detection signal of the sine output waveform is similarly derived, so that the positional alignment of the toner images can be realized by phase adjustment of the two sine waveforms. With a simple circuit constitution, precise phase alignment control can be effected. For example, each of the sine waveforms is subjected to timewise differentiation to obtain a slope and then control can be effected so that points of maximum slopes of the two sine waveforms coincide with each other.

As shown in FIG. 7, in the magenta image forming portion 43*b*, the drum code reading sensor 34*b* and the belt code reading sensor 33*b* are disposed on the same rectilinear line at the primary transfer portion Tb. The belt code reading sensor 33*b* and the drum code reading sensor 34*b* are disposed at the same phase position corresponding to the primary transfer nip.

For this reason, in the case where the yellow toner image and the magenta toner image are accurately superposed with each other, the electrostatic image code 31*b* of the photosensitive drum 12*b* is detected and at the same time, the electrostatic image code 31*a* of the intermediary transfer belt 24 is detected.

Further, in the case where these codes are not detected at the same time, control is effected so that the electrostatic image code 31*b* detected by the drum code reading sensor 34*b* and the electrostatic image code 31*a* detected by the belt code reading sensor 33*b* are phase-aligned. The electrostatic image code 31*a* corresponding to the yellow toner image is read by the belt code reading sensor 33*b* and then the photosensitive drum 12*b* is positioned so that the electrostatic image code 31*b* corresponding to the photosensitive drum 12*b* positionally aligned with the electrostatic image code 31*a*.

By changing the rotational speed of the photosensitive drum 12*b* so as to follow the electrostatic image code 31*a* transferred on the electrostatic image transfer area 25 of the intermediary transfer belt 24, the positional deviation between the yellow and magenta toner images on the intermediary transfer belt 24 can be corrected.

Thereafter, also in the image forming portions 43*c* and 43*d* shown in FIG. 2, the detection of the electrostatic image code 31*a* on the intermediary transfer belt 24 and the control for adjusting the rotational speeds (phases) of the photosensitive drums 12*c* and 12*d* are similarly effected. As a result, it is possible to output a high-quality image with less color misregistration of the respective color toner images.

Incidentally, the electrostatic image code 31*a* transferred on the intermediary transfer belt 24 is read by the belt code reading sensors 33*b*, 33*c* and 33*d* each disposed at the inner surface of the intermediary transfer belt 24 spaced from the electrostatic image code 31*a* with the thickness of the intermediary transfer belt 24.

However, whether the side where the belt code reading sensors 33*b*, 33*c* and 33*d* are disposed to detect the electrostatic image code 31*a* is provided at the front surface or the back surface of the intermediary transfer belt 24 is selectable depending on a material characteristic of the intermediary transfer belt, process design, production specifications and the like.

<Problem of Transfer Roller>

FIG. 8 is an illustration of a constitution of the toner portion of the yellow image forming portion in a comparative embodiment.

As shown in FIG. 8, in the comparative embodiment, in the electrostatic image transfer area 25 provided at each of the widthwise end portions of the intermediary transfer belt 24, a dedicated electrostatic image transfer roller 47 is provided. The electrostatic image transfer roller 47 is constituted by an electroconductive sponge roller similarly as in the case of the primary transfer roller 4*a* and is rotated coaxially with the primary transfer roller 4*a*. However, the electrostatic image transfer roller 47 is electrically independent from the primary transfer roller 4*a*, so that a dedicated voltage different from that for the primary transfer roller 4*a* is applicable to the electrostatic image transfer roller 47 from a power source other than that for the primary transfer roller 4*a*.

In the image forming portion 43*a*, when the toner image is formed on the photosensitive drum 12*a*, outside the image forming area 90 of the photosensitive drum 12*a*, the electrostatic image code 31*a* is formed by the laser beam exposure. At each of the longitudinal end portions of the photosensitive drum 12*a*, a linear electrostatic image code 31*a* is formed with a width and interval correspondingly to a predetermined number of scanning lines by using the laser beam scanning portion before or after the image writing. In FIG. 8, the electrostatic image code 31*a* is formed at both end portions of the photosensitive drum 12*a* but in some cases, the electrostatic image code 31*a* is formed only at one end portion of the photosensitive drum 12*a*.

The primary transfer roller 4*a* is supplied with a positive transfer voltage from a power source D12 to attract the toner image on the photosensitive drum 12*a* to the surface of the intermediary transfer belt 24 by an electrostatic force, thus transferring the toner image. On the other hand, the electrostatic image transfer roller 47 is supplied with a positive transfer voltage, different in value from the voltage applied to the primary transfer roller 4*a*, from a power source D47, thus transferring the electrostatic image code 31*a* from the photosensitive drum 12*a* onto the electrostatic image transfer area 25 of the intermediary transfer belt 24. The electrostatic image transfer roller 47 transfers the electric charges constituting the electrostatic image code 31*a* onto the electrostatic image transfer area 25 under an optimum condition different from a transfer condition of the toner image.

However, in this case, separately from the primary transfer roller 4*a* for transferring the toner image for the image, the electrostatic image transfer belt 47 is needed and thus in an adjacent region, the transfer roller with a different potential is required to be newly added.

Further, to the electrostatic image transfer roller 47, the transfer voltage different from the toner image transfer voltage is required to be applied and there is need to provide the bias voltage (power) source connected to the added transfer roller every image forming portion.

Further, the electrostatic image code 31*a* may desirably be transferred onto the adjust adjacent to the image forming area 90 as close as possible. However, e.g., in the case where the transfer potential of the toner image for the image is 1500 V and the transfer potential of the electrostatic image code 31*a* is 1000 V, in adjacent places, the two transfer rollers different in potential are rotated in interrelation with each other. In that case, in order to avoid electric discharge between the transfer rollers with the different potentials, a certain spacing (gap) or more is required to be provided, so that there is a need to provide an unnecessary space in a mechanism system in the neighborhood of the end portion of the intermediary transfer belt 24.

Therefore, in embodiments described later, as shown in FIG. 9, a primary transfer roller 51 common to the image forming area 90 and the electrostatic image transfer area 25 is provided, so that the same transfer voltage is applied to the image forming area 90 and the electrostatic image transfer area 25.

<Integral Primary Transfer Roller)

FIG. 9 is an illustration of a constitution of the transfer portion of the yellow image forming portion.

As shown in FIG. 9, in the image forming portion 43*a*, to the electrostatic image transfer area 25 provided at each of the end portions of the intermediary transfer belt 24, the transfer voltage is applied by the primary transfer roller 51 which also functions as the roller for transferring the toner image for the image. The primary transfer roller 4*a* shown in FIG. 8 is extended as it is to the area in which the electrostatic image code 31*a* is transferred, thus obtaining the primary transfer roller 51 used in Embodiment 1. As a result, it becomes possible to transfer the toner image for the image from the photosensitive drum 12*a* onto the intermediary transfer belt 24 and to transfer the electrostatic image code 31*a* at the same time.

The primary transfer roller 51 continuously contacts the intermediary transfer belt 24 from the image forming area 90 to the electrostatic image transfer area 25 and is supplied with a transfer voltage Vt, optimized for the toner image transfer, by a power source D51. As a result, the toner image for the image is transferred from the image forming area and at the same time, the electric charge pattern constituting the electrostatic image code 31*a* is transferred onto the intermediary transfer belt, so that the electrostatic image code 31*a* is formed on the electrostatic image transfer area 25.

<Code Erasing Roller>

As shown in FIG. 2, corresponding to the electrostatic image transfer area 25 of the intermediary transfer belt 24, a code (scale) erasing roller 52 and an opposite erasing roller are disposed. The code erasing roller 52 and the opposite code erasing roller 53 is provided for erasing the preceding (previous) electrostatic image code 31*a* formed in the electrostatic image transfer area 25 of the intermediary transfer belt 24 to initialize the charge potential of the electrostatic image transfer area 25.

FIG. 3 shows a relationship among the yellow image forming portion 43*a*, the magenta image forming portion 43*b* and the controller 54, and in the figure, the cyan image forming portion 43*c* and the black image forming portion 43*d* are omitted. With respect to the controller 54, only a control portion for controlling pre-charging of the intermediary transfer belt 24 is enlarged and a voltage controller 103 controls an AC voltage controller 101 and a DC voltage controller 104. An AC voltage of the AC voltage controller 101 is superposed on DC voltage of the DC voltage controller 104, and a superposition oscillating voltage is applied to the code erasing roller 52 via a voltage applying portion 102.

To the code erasing roller 52 contacting the electrostatic image transfer area 25, the oscillating voltage in the form of the AC voltage biased with the DC voltage is applied from a code erasing power source D52, and the opposite code erasing roller 52 is connected to the ground potential. The AC voltage of the oscillating voltage is used for erasing the electrostatic image code transferred in the previous image formation, i.e., for flattening and smoothing potential unevenness on the intermediary transfer belt 24. As the AC voltage, a sine wave, a rectangular wave, a pulse wave or the like can be used. On the other hand, the DC voltage of the oscillating voltage is, as described above, a voltage necessary to the pre-charging for eliminating the transfer problem by providing the primary transfer roller 51 common to the image forming area 90 and the electrostatic image transfer area 25 to transfer the electrostatic image code 31*a* at the transfer voltage optimized for the toner image transfer. A magnitude and setting method of the DC voltage necessary for the pre-charging will be described later.

The pre-charging of the electrostatic image transfer area 25 of the intermediary transfer belt 24 to a certain DC potential at a uniform level is performed together with an erasing step of the electrostatic image code 31*a* by using a member for erasing the electrostatic image code 31*a*.

Incidentally, the code erasing roller 52 and the opposite code erasing roller 53 may also be disposed at any position located downstream of the image forming portion 43*d* and upstream of the image forming portion 43*a*. However, there is a possibility that a charging state of the electrostatic image transfer area 25 is changed by the influence of the secondary transfer, external noise or the like and therefore the erasing rollers 52 and 53 may desirably be disposed immediately before the image forming portion 43*a*. For erasing the electrostatic image code 31*a*, it is also possible use another charging means such as corona charger.

<Embodiment 1>

FIG. 10 is an illustration of control for obtaining a transfer voltage adapted to transfer of the electrostatic image code. FIG. 11 is a graph for illustrating a relationship between an electrostatic image contrast of an electrostatic image pattern transferred onto the intermediary transfer belt, and the transfer voltage.

As shown in FIG. 2, the photosensitive drum 12*a* which is an example of an image bearing member contacts the intermediary transfer belt 24, which is an example of a belt member, at the transfer portion of the toner image for the image. The exposure device 16*a* which is an example of an electrostatic image forming means forms the electrostatic image for the image on the photosensitive drum 12*a*. The primary transfer roller 51 which is an example of the transfer member transfers the toner image for the image at the transfer portion Ta by using the transfer voltage Vt which is an example of an electric condition adapted to the transfer of the toner image for the image.

The electrostatic image code 31*a* is transferred from the photosensitive drum 12*a* onto the intermediary transfer belt 24 and is used in control for superposing, on the already formed on the intermediary transfer belt 24, the toner image for the image formed on the photosensitive drum 12*b* which is an example of another image bearing member disposed downstream of the photosensitive drum 12*a* with respect to the rotation direction of the intermediary transfer belt 24.

The electrostatic image transfer area 25 in which the electrostatic image code 31*a* is to be transferred is made higher in resistance than that of the toner image transfer area 90 corresponding to the area in which the toner image for the image is carried on the photosensitive drum 12*a*, and is disposed at the widthwise outside portion of the intermediary transfer belt 24. The electrostatic image code 31*a* is formed by the exposure device 16*a* in a code (scale)-like shape such that contours perpendicular to the rotational direction of the photosensitive drum 12 are arranged in a predetermined number of scanning lines at predetermined interval.

The electrostatic image code 31*a* transferred on the intermediary transfer belt 24 is, at the transfer position of the toner image for another image formed on the photosensitive drum 12*b*, subjected to detection of induced current with movement by the belt code reading sensor 33*b* which is an example of the antenna potential sensor.

In many cases, the voltage for permitting suitable transfer of the electrostatic image code 31*a* from the photosensitive drum 12*a* onto the electrostatic image transfer area 25 of the intermediary transfer belt 24*a* is generally different from the voltage for permitting suitable transfer of the toner image from the photosensitive drum 12*a* onto the intermediary transfer belt 24.

As shown in FIG. 10, a charging state of the electrostatic image in the case where the electrostatic image transfer area 25 of the intermediary transfer belt 24 was not subjected to the pre-charging was evaluated. The photosensitive drum 12*a* was subjected to the exposure with scanning lines of 600 dpi to form the electrostatic image pattern of 1000 dots (42.6 mm) and 1000 spaces (42.6 mm), and the electrostatic image pattern was transferred onto the electrostatic image transfer area 25 of the intermediary transfer belt 24 while changing the transfer voltage Vt at a plurality of levels. The electrostatic image pattern transferred on the electrostatic image transfer area 25 was evaluated by using a potential sensor EM of a conventional electrostatic capacity type. The potential sensor EM was used for the detection and therefore an electrostatic image index larger than the actual electrostatic image code 31*a* was transferred onto the electrostatic image transfer area 25, so that a low-potential portion voltage Vlight (V) and high-potential portion voltage Vdark (V) of the electrostatic image index after the toner were measured. A relationship between the transfer voltage Vt (V) and an electrostatic image contrast (Vdark-Vlight) (V) is shown in FIG. 11. In FIG. 11 and the following description, Vlight is referred to as Vl, Vdark is referred to as Vd and the electrostatic image contrast (Vdark-Vlight) is referred to as (Vd-Vl).

As shown in FIG. 11, an electric field between the photosensitive drum 12*a* and the electrostatic image transfer area 25 is increased with an increase in transfer voltage Vt, so that the transfer (electric discharge) starts from about Vd of 400 V and then from about Vl of 800 V. Correspondingly, the electrostatic image contrast (Vd-Vl) is also increased.

However, when the transfer voltage is continuously increased, the electrostatic image contrast is changed to decrease with a certain point as a peak. This may be attributable to a phenomenon that abnormal electric discharge is liable to occur between the photosensitive drum 12*a* and the electrostatic image transfer area 25 and as a result, a transfer efficiency of the electrostatic image patch is lowered.

In the neighborhood of the peak of the electrostatic image contrast (Vd-Vl) curve in FIG. 11, even with respect to the actual electrostatic image code 31*a*, it is considered that the electrostatic image contrast (Vd-Vl) is highest and therefore a highest signal of SN ratio is obtained even by the detection with the antenna potential sensor 330. Therefore, a transfer voltage (Vt0) in the neighborhood of the voltage providing a maximum of the electrostatic image contrast (Vd-Vl) is most suitable for the transfer of the electrostatic image code 31*a*.

<Suitable Pre-charging Voltage>

FIG. 12 is an illustration of an effect of pre-charging. FIG. 13 is a graph for illustrating a relationship between an optimum contact voltage for electrostatic image transfer and the transfer voltage. FIG. 14 is an equivalent circuit of a transfer portion in transfer of the electrostatic image with the pre-charging.

In the transfer of the electrostatic image patch shown in FIG. 10, a relationship between the electrostatic image contrast (Vd-Vl) and the transfer voltage in the case where the electrostatic image transfer area 25 of the intermediary transfer belt 24 was pre-charged in advance was measured. A result thereof is shown in FIG. 12.

As shown in FIG. 10, the DC voltage of the oscillating voltage applied to the code erasing roller 52 was changed to +341 V and −244 V to set the pre-charging voltage of the electrostatic image transfer area 25 at +341 V and −244 V and then the voltages Vd and Vl were measured by the potential sensor EM similarly as in the case of FIG. 11.

As shown in FIG. 12, the curve of the electrostatic image contrast (Vd-Vl) of the electrostatic image transferred on the electrostatic image transfer area 25 is substantially translated depending on the pre-charging voltage. The transfer voltage providing the peak of the electrostatic image contrast (Vd-Vl) curve was determined as an optimum transfer voltage for permitting transfer of the electrostatic image at each of the pre-charging voltages of +341 V and −244 V. Further, also at each of other two pre-charging voltages determined between the pre-charging voltages of +341 V and −244 V, the electrostatic image contrast curve was similarly obtained to determine the peak-providing transfer voltage. When a relationship between the pre-charging voltage and the optimum transfer voltage for the electrostatic image transfer was obtained, a linear relationship as shown in FIG. 13 was obtained.

As shown in FIG. 13, by changing the pre-charging voltage in a range from +341 V to −244 V< it was turned out that the transfer voltage applied to the primary transfer roller 51 was selectable as an arbitrary value in a range from 600 V to 12. That is, when the transfer voltage is set at a value in the range from 600 V to 1200 V so that the toner image transfer efficiency is maximum, by adjusting the pre-charging voltage, it is possible to ensure the transfer voltage for permitting optimum transfer of the electrostatic image code 31*a* onto the electrostatic image transfer area 25. As a result, the electrostatic image code 31*a* is transferred with high accuracy, so that the positional deviation of the toner images on the intermediary transfer belt 24 can be corrected with high accuracy and thus it is possible to provide the image forming apparatus with less color misregistration.

This can be explained by an equivalent circuit shown in FIG. 14. Here, the electrostatic capacity at the surface of the photosensitive drum 12*a* is Cd, and the electrostatic capacity of an air layer between the photosensitive drum 12*a* and the electrostatic image transfer area 25 is Cair.

When the electrostatic capacity of the intermediary transfer belt 24 is Cb, a surface potential Vb of the electrostatic image transfer area 25 is the sum of a potential difference Vpre by pre-charging electric charges and a transfer potential Vt applied to the primary transfer roller 51. With respect to the surface potential Vb of the electrostatic image transfer area 25, the transfer voltage is zero outside the nip, and the transfer voltage Vt is applied in the neighborhood of the nip area in which the electric discharge occurs between the electrostatic image transfer area 25 and the photosensitive drum 12*a*.

As shown in FIG. 10, the transfer efficiency of the electrostatic image is determined by a difference between the potential Vb (=Vst+Vpre) and the high-potential portion potential (Vd) or low-potential portion potential (Vl) of the electrostatic image formed on the photosensitive drum 12*a*. In this case, the potential Vb of the electrostatic image transfer area 25 is irrespective of any combination of the transfer voltage Vt and the pre-charging voltage Vpre. The transfer voltage Vt optimum for the electrostatic image transfer is a constant peculiar to an electrostatic image transfer process including the photosensitive drum 12*a* and the intermediary transfer belt 24. This is also clear from the fact that the relationship between the pre-charging voltage Vpre and the transfer voltage Vt providing the peak of the electrostatic image contrast (Vd-Vl) curve is rectilinear line with a slope of substantially "−1" as shown in FIG. 13.

Here, Vt is the transfer voltage at which the toner image transfer efficiency is maximum, Vpre is the pre-charging potential of the electrostatic image transfer area 25, and Vt0 is the surface potential Vb of the electrostatic image transfer area 25 providing the peak of the electrostatic image contrast (Vd-Vl) curve. When these potentials (voltages) are represented by a formula, the following equation is obtained, so that various combinations of Vt and Vpre become possible in order to obtain the surface potential Vt0 of the electrostatic image transfer area 25 optimum for the electrostatic image transfer.

$$Vt+V\text{pre}=Vt0 \quad (1)$$

As shown in FIG. 10, the transfer voltage Vt applied to the primary transfer roller 51 is optimized for the toner image transfer and therefore even when the electrostatic image code 31*a* is transferred at the same transfer voltage Vt, the transfer of the electrostatic image code 31*a* is not optimized in general. Therefore, the controller 54 applies the potential Vpre derived from the equation (1) to the electrostatic image transfer area 25 in advance before the transfer. The potential Vpre applied in advance can be calculated from the following equation by using Vt0 and Vt derived on the basis of a measurement result during product design.

$$V\text{pre}=Vt0-Vt \quad (2)$$

Incidentally, the surface potential of the electrostatic image transfer area 25 optimum for the transfer of the electrostatic image code 31*a* was determined here by the voltage providing the maximum of the (Vd-Vl) curve. However, the method of the determining the surface potential of the electrostatic image transfer area 25 optimum for the transfer of the electrostatic image code 31*a* is not limited to this method. Within a range in which sufficient accuracy with which the toner image positional deviation is corrected is ensured, the optimum surface potential can also be determined from a voltage range in the neighborhood of a pinpoint voltage value providing the maximum of the (Vd-Vl) curve.

Further, it is also possible to store a Vpre/Vt conversion table in a memory of the controller 54 by obtaining numerical data of FIGS. 12 and 13 before product shipment without obtaining the value of the equation (2) by conducting an experiment every occurrence. It is further possible to determine the optimum pre-charging potential Vpre depending on a printing environment on the basis of the Vpre/Vt conversion table every time when the transfer voltage Vt optimized for the transfer of the toner image for the image is obtained.

<Embodiment 2>

FIG. 15 is a flow chart of pre-charging control in Embodiment 2. In this embodiment, the experiment in Embodiment 1 is automatically performed with respect to the intermediary transfer belt 24 before the product shipment, so that an initial setting potential for the pre-charging is obtained.

As shown in FIG. 15 with reference to FIG. 10, the intermediary transfer belt 24 is formed, at its entire surface, of a polyimide layer of $1\times10^{10}$ Ω.cm in volume resistivity. At each of end portions of the surface, as the electrostatic image transfer area, a 30 μm-thick insulating layer of polyimide of $1\times10^{15}$ Ω.cm in volume resistivity is laminated. To the code erasing roller 52, the oscillating voltage in the form of the sine wave of 2 kHz in frequency and 3 kV in amplitude biased with the DC voltage is applied.

The controller 54 shown in FIG. 10 starts the control using i=1 (S01). The controller 54 applies to the code erasing roller 52 the oscillating voltage in the form of a DC voltage Vpi (i=1, 2, 3) biased with the AC voltage, thus charging the electrostatic image transfer area 25 to a potential Vp1 and then the (Vd-Vl) curve in FIG. 12 is obtained by changing the transfer voltage Vt (S02). The primary transfer bias providing the maximum is taken as Vt1 (S03).

The controller 54 judges whether i=3 or not (SO4) and when i is not 3 (NO of SO4), i=+1 is set (S05) and then the operation from S01 to S04 is repeated. The value i may be the number of times in which the linear approximation of FIG. 13 can be effected with accuracy.

The controller 54 completes, in the case of i=3 (YES of S04), the measurement and obtains the relationship between the pre-charging voltage and the transfer voltage (S06). With respect to Vt1, Vt2 and Vt3 for Vp1, Vp2 and Vp3 obtained in the previous step, as shown in FIG. 13, values of (Vt1, Vp1, Vt2, Vp2) and (Vt3, Vp3) are plotted (S06). From an approximation formula of a rectilinear line connecting these three points, the belt surface potential Pt0 optimum for the electrostatic image transfer is obtained.

The controller 54 calculates the pre-charging potential applied to the intermediary transfer belt 24 from the equation: Vpre=Vt0−Vt (S07).

As shown in FIG. 13, specifically in the case where the belt surface potential Vt0 optimum for the electrostatic image transfer is given at 930 V and the transfer bias for the transfer used in this embodiment is given at 1170 V, the contact voltage can be determined by an equation as shown below. Before the product shipment of the intermediary transfer belt 24, 930 V is derived as the belt surface potential Vt0 optimum for the transfer of the electrostatic image index, and then the pre-charging potential Vpre depending on the transfer bias Vt for the toner image for the image is calculated from the equation (2) below.

$$Vpre=Vt0-Vt=930-1170=-240\text{ V}$$

Therefore, as an initial setting of the intermediary transfer belt 24, the oscillating voltage in the form of the DC voltage of −240 V for the pre-charging biased with the AC voltage is set.

After the product shipment, in the image forming portions 43*b*, 43*c* and 43*d* shown in the figures, the positional alignment of the toner images for the image is performed in accordance with the detection signal of the electrostatic image code 31*a* of the intermediary transfer belt 24 by the belt code reading sensors 33*b*, 33*c* and 33*d*. At that time, by effecting the pre-charging under the condition obtained in Embodiment 2, compared with the case where the pre-charging is not effected, the electrostatic image code 31*a* is transferred satisfactorily and therefore it becomes possible to finally alleviate the amount of color misregistration of the respective color images on the recording material.

The DC voltage of the oscillating voltage applied to the code erasing roller 52 was set at the initial setting voltage of −240 V. At this time, when the potential sensor (electrometer) EM was provided at a position after the electrostatic image code passes through the code erasing roller 52 and before the electrostatic image code reaches the photosensitive drum 12*a* and then was used to measure the surface potential of the electrostatic image transfer area 25, about −240 V was obtained.

An actual measurement result is shown. Onto the electrostatic image transfer area 25 which is pre-charged to −240 V, the electrostatic image index of 1000 dots (42.6 mm) and 1000 spaces (42.6 mm) is transferred from the photosensitive drum 12*a*. When the potential sensor EM was provided downstream of the photosensitive drum 12*a* to measure the surface potential of the electrostatic image index transferred on the electrostatic image transfer area 25, as shown in FIG. 10, the surface potential at respective positions before and after the transfer were measured.

The high-voltage portion potential (Qd) of the electrostatic image index at the surface of the photosensitive drum 12*a* is −500 V and the low-voltage portion potential (Ql) is −100 V. A dielectric constant of the photosensitive layer of the photosensitive drum 12*a* and that of the electrostatic image transfer area 25 of the intermediary transfer belt 24 are substantially equal to each other and thicknesses of the photosensitive layer and the electrostatic image transfer area are 30 μm and 50 μm, respectively, so that a ratio of electrostatic capacity between these layer and area is 4:1.

When the intermediary transfer belt 24 passes through the photosensitive drum 12*a*, the electric discharge occurs due to the potential difference from the electrostatic image index on the photosensitive drum 12*a*. The potential of the electrostatic image transfer area 25 was −240 V as described above, and the potential of the high-voltage portion of the electrostatic image index on the photosensitive drum 12*a* was −500 V and the potential of the low-voltage portion was −100 V. In this case, the potential differences between the respective portions during the electric discharge are as follows.

(1) Between low-voltage portion and electrostatic image transfer area 25: (1170−240)−(−100)=1030 V (2) Between high-voltage portion and electrostatic image transfer area 25:

(1170−240)−−500)=1430 V

Further, as a result of the electric discharge on the photosensitive drum 12*a*, the potential of the electrostatic image index transferred on the electrostatic image transfer area 25 was measured as follows.

(3) Area in which low-voltage portion is transferred on electrostatic image transfer area 25: −310 V (4) Area in which high-voltage portion is transferred on electrostatic image transfer area 25: −500 V In this case, the amounts of electric charges moved on the photosensitive drum 12*a* and the intermediary transfer belt 24 when the electrostatic image index is transferred are equal to each other and therefore when the capacity ratio is converted into the voltage change ratio in consideration of the capacity ratio of 4:1 (photosensitive layer:intermediary transfer belt), the voltage change ratio is as follows. That is, at both of the high-voltage portion and low-voltage portion of the electrostatic image index, the potential (voltage) change amount ratio of the photosensitive drum 12*a* and the electrostatic image transfer area 25 is the reverse of the capacity ratio, i.e., 1:4.

(5) Low-voltage portion of electrostatic image index on photosensitive drum 12*a*: The potential changes from −100 V (before transfer) to −82 V (after transfer) by 18 V.

(6) Electrostatic image transfer area (low-voltage portion): The potential changes from −240 V to −310 V by 70 V.

(7) High-voltage portion of electrostatic image index on photosensitive drum 12*a*: The potential changes from −500 V (before transfer) to −435 V (after transfer) by 65 V.

(8) Electrostatic image transfer area (high-voltage portion): The potential changes from −240 V to −500 V by 260 V.

<Electrostatic Image Index Other Than Electrostatic Image Code>

Incidentally, with respect to the method in which the electrostatic image index is transferred onto the intermediary transfer belt or the recording material conveyer belt and then the positional alignment of the toner images is effected, there are methods other than the method in which the positional correction is made in real time by using the electrostatic image code 31*a*.

During the continuous image formation, on the basis of detection data of the electrostatic image index transferred on the intermediary transfer belt 24, it is possible to correct the positional deviation of the toner images for the image by adjusting exposure start timing for the photosensitive drums 12*b*, 12*c* and 12*d*. Also in such control, the present invention can be applied.

Further, the present invention can also be applied to the conventional technique such that a positioning toner image is transferred from the photosensitive drum for each color onto the intermediary transfer belt during the non-image formation and then the positioning toner image on the intermediary transfer belt is detected to adjust the exposure start timing for the photosensitive drums 12*b*, 12*c* and 12*d*. In place of the positioning toner image, the electrostatic image index is transferred from the photosensitive drums 12*a*, 12*b*, 12*c* and 12*d* onto the intermediary transfer belt and is detected at a downstream position of the photosensitive drum 12*d*, so that the exposure start timing of each color image may be adjusted.

Further, in the image forming portions 43*a*, 43*b*, 43*c* and 43*d* shown in FIG. 1, electrostatic image patches each of about 30 mm square in size are formed as the electrostatic image index and then can be transferred onto the intermediary transfer belt. Then, by a potential sensor of an electrostatic capacity type provided downstream of the image forming portion 43*a*, the electrostatic image patches corresponding to the image forming portions 43*b*, 43*c* and 43*d* are read. Then, on the basis of a difference in reading time of the electrostatic image patches, the amount of positional deviation from the electrostatic image patch for the image forming portion 43*a* is calculated for each of the image forming portions 43*b*, 43*c* and 43*d*. Thereafter, when a subsequent image is formed, on the basis of a result of this calculation, image writing timing for the photosensitive drums 12*b*, 12*c* and 12*d* is corrected. Alternatively, the photosensitive drum is moved in the rotational direction of the intermediary transfer belt, so that the position of the photosensitive drum is corrected.

<Embodiment 3>

FIG. 16 is a flow chart of pre-charging control in Embodiment 3. In this embodiment, the pre-charging potential of the intermediary transfer belt started to be used at the initial setting in Embodiment 2 is adjusted depending on an environmental condition or a change with time.

In the image forming apparatus 100 after the product shipment, the optimum transfer voltage for the toner image for the image is changed by the influence of the environmental condition such as ambient temperature or humidity or by the change with time of the process members including the intermediary transfer belt 24. In this case, as shown in the above-described equation (2), there is a need to change also the pre-charging potential with the change in transfer voltage of the toner image for the image. Further, according to an experiment, it has been found that similarly as in the case of the toner image for the image, the transfer voltage optimum for transfer of the electrostatic image code 31*a* has a temperature characteristic and a humidity characteristic. For that reason, also with respect to the pre-charging potential Vpre of the electrostatic image transfer area 25, there is a need to be adjusted correspondingly to the ambient temperature and humidity.

As shown in FIG. 16 with reference to FIG. 3, in the neighborhood of the intermediary transfer belt 24 in the image forming apparatus 100, an unshown temperature and humidity sensor is provided. Further, in the memory of the controller 54, a temperature and humidity characteristic table optimum for the transfer of the toner images for the image and a temperature and humidity characteristic table optimum for the electrostatic image code are prepared in advance. The controller 54 always monitors the temperature and the humidity in the image forming apparatus 100 which is continuously operated and in the case where the ambient temperature or humidity is changed, the controller 54 sets the optimum potential by making reference to the temperature and humidity characteristic table.

The controller 54 obtains an output of the temperature and humidity sensor during the image formation to measure the ambient temperature and humidity (S11). Then, by making reference to the table at the detected temperature and humidity, a transfer voltage Vt0 at which the electrostatic image code 31*a* can be optimally transferred when the pre-charging potential of the intermediary transfer belt 24 is zero at the detected temperature and humidity is obtained (S12). Further, by making reference to the table at the detected temperature and humidity, a transfer voltage Vt at which the toner image for the image can be optimally transferred is obtained (S13).

The above-described equation (2) is applied when Vt is the optimum transfer voltage for the toner image for the image under the temperature and humidity environment in which the image forming apparatus is used, Vpre is the pre-charging potential of the belt, and Vt0 is the belt surface potential Vb optimum for the transfer of the electrostatic image code.

The controller 54 determines, by the equation (2): Vpre=Vt0−Vt, the belt pre-charging potential optimum under the environment during the operation (S14). Then, simultaneously with erasure of the electrostatic image code 31*a* formed during the previous image formation, the potential Vpre is applied, as the DC voltage of the oscillating voltage, to the code erasing roller 52 (S15) and is continued to the image formation (the primary transfer bias application and collective transfer of the electrostatic image code and the toner image are executed in the first image forming area) (S16). In the image forming apparatus 100 in operation, the above process is repeated.

When the image forming apparatus 100 in which the control in this embodiment is to be effected was placed in an environment of room temperature of 27° C. and humidity of 60% RH, the temperature and the humidity in a space inside the apparatus were changed to the temperature of 32° C. and the humidity of 40% RH during the continuous image formation. As a result of the control in this embodiment, immediately after the start of the continuous image formation and after a lapse of 6 hours from the start, the transfer voltage optimum for the toner image for the image was automatically changed and in addition, the pre-charging potential of the electrostatic image transfer area 25 was also automatically changed.

As a result, with respect to the color misregistration of the respective color toner images on the recording material at each of times after lapse of 10 min., 30 min., 1 hour, 2 hours, 3 hours and 6 hours from the start of the continuous image formation, a result which bears comparison with that immediately after the start was obtained.

<Embodiment 4>

Figure 19:
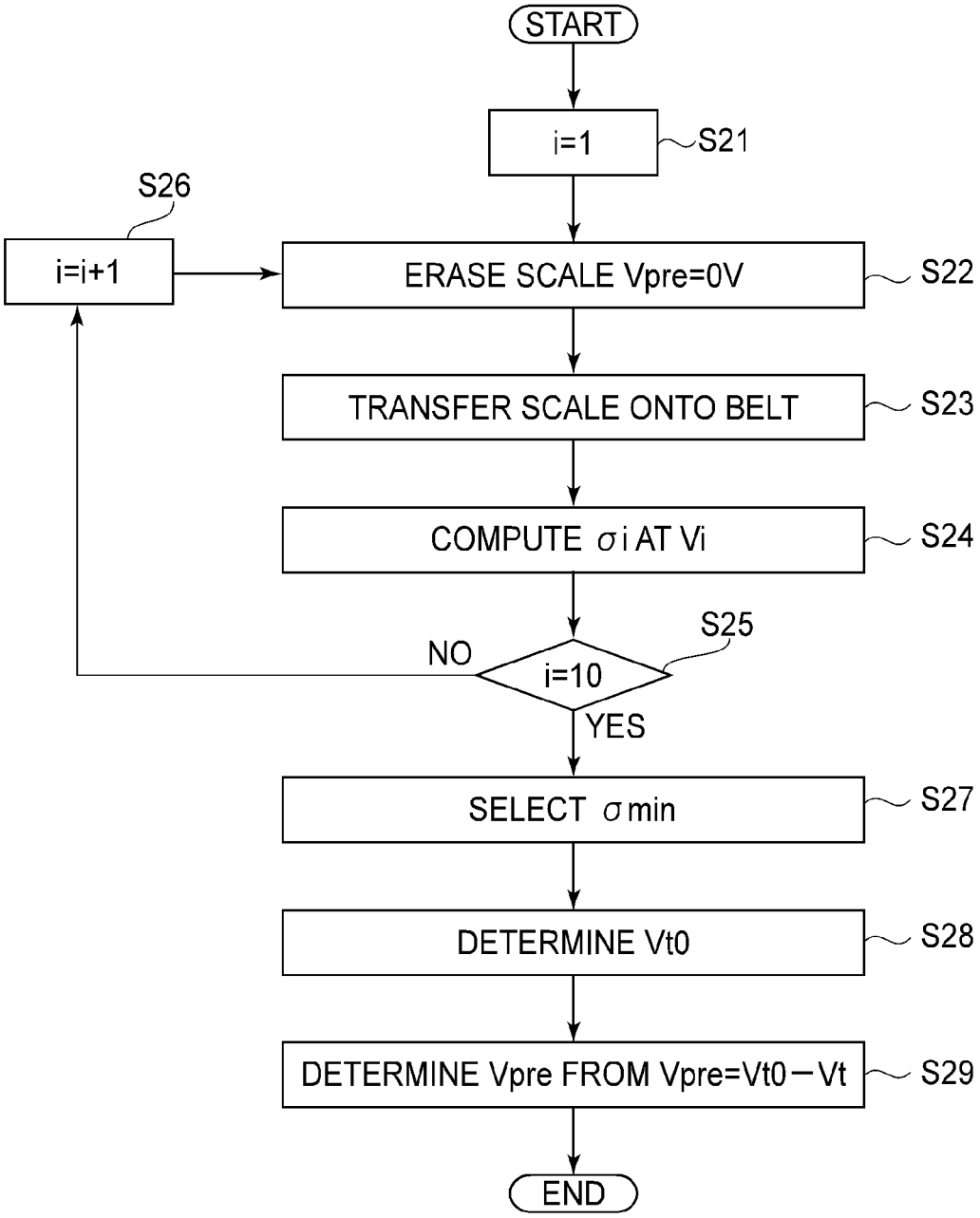

Parts (*a*) and (*b*) of FIG. 17 are illustrations of evaluation of the electrostatic image code transferred onto the intermediary transfer belt. Parts (*a*) and (*b*) of FIG. 18 are illustrations of a change in detection signal of the antenna potential sensor. FIG. 19 is a flow chart of pre-charging control in Embodiment 4. In FIG. 17, in order to illustrate a relationship with the electrostatic image code 31*a*, flexible print boards and grounding portions of the belt code potential sensors 33*b* and 33*b*' are omitted. In this embodiment, by using an antenna potential sensor (electrostatic image detecting probe) 330 shown in FIG. 4, a transfer quality of the actual electrostatic image code 31*a* transferred on the electrostatic image transfer area 25 is evaluated and then the optimum pre-charging potential Vpre is set.

As shown in FIG. 3, the controller 54 forms the electrostatic image code 31*a* on the photosensitive drum 12*a* by using the exposure device 16*a* and then applies the transfer voltage Vt to the primary transfer roller 51, so that the electrostatic image code 31*a* is transferred onto the intermediary transfer belt 24. Then, the electrostatic image code 31 transferred on the intermediary transfer belt 24 is detected by the belt code potential sensor 33*b* and the superposition (registration) of the plurality of the toner images for the image to be transferred onto the intermediary transfer belt 24 is controlled.

The code erasing roller 52 which is an example of the belt member charging means electrically charges the intermediary transfer belt 24, before the transfer, to the DC potential. This is because the transfer of the electrostatic image code 31*a* onto the electrostatic image transfer area 25 is also optimally performed at the voltage Vt set for the toner image transfer.

The code erasing roller 52 contacts the electrostatic image transfer area 25 and is supplied with the oscillating voltage in the form of the AC voltage biased with the DC voltage, so that the electrostatic image transfer area 25 is charged to the DC voltage potential. The code erasing roller 52 is also functions as a means for erasing the previous electrostatic image code 31*a* transferred on the electrostatic image transfer area 25.

The controller which is an example of the control means adjusts the DC voltage of the voltage applied to the code erasing roller 52 correspondingly to the change in transfer voltages Vt and Vt0. The controller 54 changes the transfer voltage Vi applied to the primary transfer roller 51 at a plurality of levels with an increment of 100 V, so that the electrostatic image code 31*a* is transferred onto the electrostatic image transfer area 25. Then, on the basis of a detection result of the electrostatic image code 31*a*, transferred on the electrostatic image transfer area 25, by the antenna potential sensor 330, the DC voltage of the oscillating voltage used during the image formation is determined.

The controller 54 determines the DC voltage of the oscillating voltage so that a variation in waveform of a detection signal of the electrostatic image code 31*a* by the antenna potential sensor 330 becomes small.

As shown in FIG. 10, in order to set the pre-charging potential Vpre, there is a need to use the potential sensor EM of the electrostatic capacity type but in the actual image forming apparatus 100, it is difficult to ensure a space in which a large-sized potential sensor EM is mounted. The large-sized potential sensor EM cannot be mounted and therefore there is also a circumstance such that the antenna potential sensor 330 shown in FIG. 4 is mounted.

Further, in order to detect the potential of the electrostatic image index by using the potential sensor EM, there is a need to use a large electrostatic image index of 1000 dots and 1000 spaces for oppositely disposing the electrode surface of the potential sensor EM and a uniform potential surface. Therefore, during setting of the pre-charging potential Vpre by using the potential sensor EM, the electrostatic image code 31*a* for positional alignment of the toner images for the image cannot be formed in the electrostatic image transfer area 25. When the large-sized electrostatic image code is used, in addition to the space problem, there is also a problem that positional alignment accuracy is lowered.

Therefore, in this embodiment, without performing the potential measurement by the potential sensor EM, the transfer voltage optimum for the transfer of the electrostatic image code 31*a* is set as the pre-charging potential Vpre. By using the antenna potential sensor 330 (belt code reading sensors 33*b* and 33*b*') shown in FIG. 4, the electrostatic image code 31*a* of the electrostatic image transfer area 25 is detected and an output signal of the detection is evaluated, so that the optimum pre-charging potential Vpre is set. In a state in which the pre-charging potential Vpre is set at 0 V, the transfer voltage Vt applied to the primary transfer roller 51 is changed at a plurality of levels and other factors are kept at the same conditions, so that the electrostatic image code 31*a* is transferred onto the electrostatic image transfer area 25.

Then, the electrostatic image code 31*a* transferred on the electrostatic image transfer area 25 is detected by the belt code reading sensor 33*b* and 33*b*', so that the transfer voltage Vt with least disturbance of the output signal is determined as the transfer voltage Vt0 optimum for the transfer of the electrostatic image code 31*a*.

As shown in (*a*) of FIG. 17, in this embodiment, two independent belt code reading sensors 33*b* and 33*b*' (antenna potential sensor 330: FIG. 4) are disposed while being slid on the electrostatic image transfer area 25 of the intermediary transfer belt 24. The belt code reading sensors 33*b* and 33*b*' are disposed and arranged at positions closest to each other so that a horizontal portion 333 is parallel to the electrostatic image code 31*a* of the electrostatic image transfer area 25. The two belt code reading sensors 33*b* and 33*b*' simultaneously read the electrostatic image codes 31*a* located at the substantially same position to output waveform signals as shown in (*a*) and (*b*) of FIG. 18.

As shown in (*a*) of FIG. 17, during the transfer of the electrostatic image code 31*a* in the state in which the pre-charging potential Vpre is set at 0 V, when the transfer voltage Vt is proper, the electrostatic image code 31*a* is regularly transferred onto the electrostatic image transfer area 25 by normal electric discharge. In this case, as shown in (*a*) of FIG. 18, the output signals of the belt code reading sensors 33*b* and 33*b*' are regularly aligned in phase, so that a standard deviation σ of a period (cycle) of a plurality of signal waveforms becomes small.

As shown in (*b*) of FIG. 17, during the transfer of the electrostatic image code 31*a* in the state in which the pre-charging potential Vpre is set at 0 V, when the transfer voltage Vt is improper, the electrostatic image code 31*a* is regularly transferred onto the electrostatic image transfer area 25 by abnormal electric discharge. In this case, as shown in (*b*) of FIG. 18, the output signals of the belt code reading sensors 33*b* and 33*b*' are irregularly disturbed in phase, so that a standard deviation σ of a period (cycle) of a plurality of signal waveforms becomes large.

Therefore, a difference in rise time between the output signals of the belt code reading sensors 33*b* and 33*b*' is measured at a plurality of points, and then the standard deviations σ of the periods of the output signals are obtained and compared with each other, so that the transfer quality of the electrostatic image codes 31*a* different in transfer voltage Vt can be evaluated.

Specifically, the rising region of the output waveform passing through the point of the potential of zero is measured. With respect to the two belt code reading sensors 33*b* and 33*b*', first point passing times are t1 and t1' and second point passing times are t2 and t2'. The measurement is made at 1000 points, so that passing times t1 to t1000 and t1' to t1000' are obtained.

Next, with respect to each point, differences in passing times between the two belt code reading sensors 33*b* and 33*b*', i.e., (t1−t1'), (t2−t2'), ... (t1000−t1000') are obtained. From dispersion of the differences in passing times (t1−t1'), (t2−t2'), ... (t1000−t1000'), the standard deviation σ is calculated.

In this case, in the case where the transfer voltage Vt is proper and the electrostatic image code 31*a* is regularly transferred by the normal electric discharge, by the transfer of the electrostatic image code 31*a* and an increase in reading accuracy, the standard deviation σ approaches zero. On the other hand, in the case where the transfer voltage Vt is improper and the electrostatic image code is irregularity transferred by the abnormal electric discharge, the standard deviation σ becomes large.

As shown in FIG. 3, in the image forming apparatus 100 in which a cumulative operation time exceeds 200 hours, through repetition of the electrophotographic process of charging, exposure, erasure and the like, a surface properties and physical values of the photosensitive drum 12*a* and the intermediary transfer belt 24 are changed compared with those during the product shipment. For this reason, the image forming apparatus 100 sets the pre-charging potential again, after being continuously operated for 200 hours, with timing of a stand-by state before print output.

As shown in FIG. 19 with reference to FIG. 3, the controller 54 sets the transfer voltage Vi, applied to the primary transfer roller 51, at 10 levels from 500 V to 1400 V with an increment of 100 V and repeats a flow from S22 to S26.

The controller 54 starts the pre-charging control with i=1 (S21) and then sets the DC voltage of the oscillating voltage applied to the code erasing roller 52 at 0 V, thus setting the pre-charging potential Vpre of the electrostatic image transfer area 25 at 0 V (S22).

The controller 54 forms, on the photosensitive drum 12*a*, the electrostatic image code 31*a* of 4 lines and 4 spaces with the resolution of 600 dpi and then transfers the electrostatic image code 31*a* onto the electrostatic image transfer area 25 of the intermediary transfer belt 24 at the transfer voltage V1=500 V (S23).

The controller 54 detects induced current of the electrostatic image code 31*a* by the belt code reading sensors 33*b* and 33*b*' (not shown) arranged at the transfer position of the photosensitive drum 12*b* and then converts the induced current into a voltage value (S34). Then, as described above, the standard deviation σ1 is calculated and stored in the memory.

The controller 54 adds i with an increment of 1 until i=10 (NO of S25) (S26) and changes the transfer voltage in the order of V1=500 V, V2=600 V, . . . V10=1400 V, so that the electrostatic image code 31*a* is transferred onto the electrostatic image transfer area 25. Then, the electrostatic image code 31*a* is detected by the belt code reading sensors 33*b* and 33b' and then the standard deviation σ1 is calculated and stored in the memory (S24).

The controller 54 selects, when i reaches 10 (YES of S25), a minimum σ from the standard deviation values σ1 to σ10 (S27). The voltage Vi providing the minimum σ is obtained as the surface potential Vt0 optimum for the transfer of the electrostatic image code 31*a* (S28).

The controller 54 substitutes the obtained Vt0 and a separately obtained transfer voltage Vt optimum for the transfer of the toner image for the image into the above-described equation (2): Vpre−Vt0−Vt, thus obtaining the pre-charging potential Vpre.

Incidentally, the transfer voltage Vt optimum for the transfer of the toner image for the image is obtained during the pre-rotation of the previous image formation. The transfer voltage is applied to the primary transfer roller 51 at three levels and then corresponding current values are measured. Three transfer voltage-current data are interposed and calculated and then the transfer voltage providing a predetermined current value (20 μA) is determined as the transfer voltage Vt optimum for the transfer of the toner image for the image.

Thus, the pre-charging potential Vpre of the electrostatic image transfer area 25 is determined (S29).

The controller 54 transfers the electrostatic image code 31*a* onto the electrostatic image transfer area 25 by using the thus obtained pre-charging potential Vpre to execute the image formation.

In the image forming apparatus 100 in which the control in Embodiment 3 is to be effected, even when the cumulative operation time exceeds 200 hours, with respect to the color misregistration of the respective color images, the result which bears comparison with that during the product shipment.

Incidentally, actual even when the electrostatic image code 31*a* is transferred at the proper pre-charging potential Vpre by the normal electric charge, the standard deviation σ does not become zero due to factors such as lateral shift of the intermediary transfer belt 24, non-uniformity of the rotational speed, a reading error of the antenna potential sensor, and the like. However, although the transfer voltage is influenced by such common factors, it can be said that the transfer voltage providing the minimum standard deviation σ becomes the transfer voltage optimum for the transfer of the electrostatic image code 31*a* when the pre-charging potential Vpre is 0 V.

Further, the increment and the number of increments of the transfer voltage Vi applied to the primary transfer roller 51 can be selected arbitrarily. In order to enhance setting accuracy of the pre-charging potential Vpre, such a selection that the increment is 10 V and the number of increments is 100 levels is also possible. However, practically sufficient setting is possible with the increment of 100 V and the number of increments of 10 levels.

Further, with respect to the setting timing of the pre-charging potential Vpre, it is not limited to the time after the lapse of 200 hours from the start of use in a brand-view state. The pre-charging potential Vpre is arbitrarily settable, for the image forming apparatus, during a change in process condition, during first turning-on of the power of the day, every predetermined cumulative operation time, before product shipment and the like.

In this embodiment, in order to evaluate quality accuracy of the electrostatic image code 31*a* transferred on the electrostatic image transfer area 25, the standard deviation of a difference in passing time of the two belt code reading sensors 33*b* and 33*b*' through the corresponding electrostatic image code 31*a* in a period was used.

However, similar control is also possible even when the standard deviation of a difference in amplitude when the electrostatic image code 31*a* with a period to which the two belt code reading sensors 33*b* and 33*b*' correspond is used. This is because a variation in output amplitude of the two belt code reading sensors 33*b* and 33*b*' becomes smaller with higher quality accuracy of the electrostatic image code 31*a*.

According to the pre-charging control in this embodiment, it is possible to output a high-quality image with less positional deviation of the respective color images. It becomes possible to effect high-sensitivity transfer of the electrostatic image code 31*a* by using the same power source as and the same primary transfer roller 51 as those for the transfer voltage of the toner image for the image.

<Embodiment 5>

Figure 20:
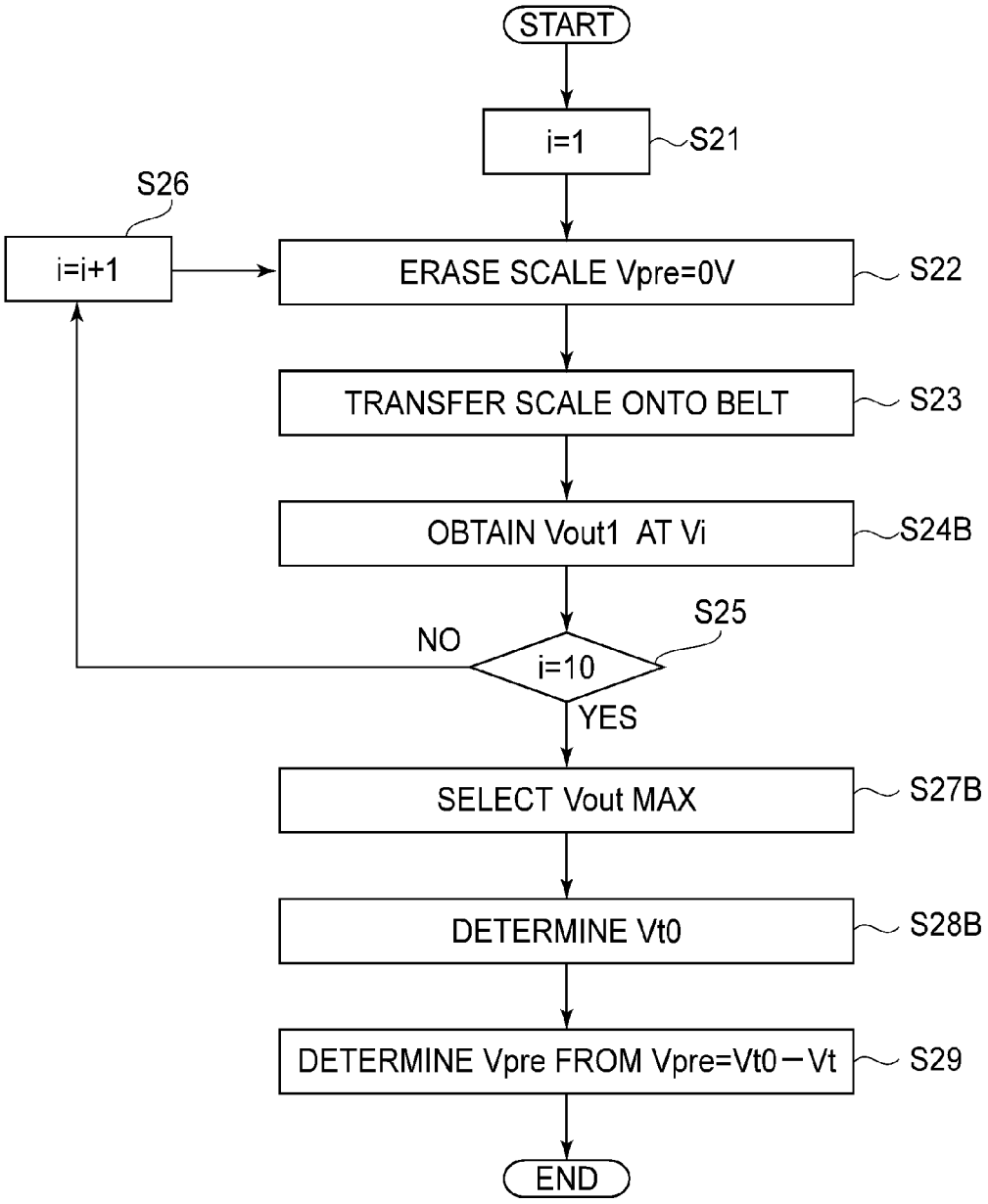

FIG. 20 is a flow chart of contact control in Embodiment 5. This embodiment is the same as Embodiment 4 except for the evaluation method of the output waveform of the antenna potential sensor and therefore in the figure, the same control as Embodiment 4 will be omitted from description by adding the common step numbers.

As shown in FIG. 20 with reference to FIG. 20, the controller 54 detects, in the image forming portion 43*a*, the electrostatic image code 31*a* transferred at the transfer voltage V1=500 V in the image forming portion 43*a*. Then, output induced current of the belt code reading sensor 33*b* is converted into a voltage value and then is integrated. An average of the voltage amplitude is stored, as an output amplitude Vout1 at the transfer voltage V1, in the memory (S24B). This operation is repeated similarly as in Embodiment 4 to obtain output amplitudes Vout1 to Vout10 at transfer voltages V1=500 V to V10=1400 V (S21 to S26).

Thereafter, the controller 54 selects a maximum output amplitude VoutMAX of the output amplitudes Vout1 to Vout10 (S27B). Then, the transfer voltage Vi at the maximum output amplitude VoutMAX is taken as the belt surface potential Vt0 optimum for the transfer of the electrostatic image code 31*a* (S28B). This is because the output amplitude when being detected by the antenna potential sensor is larger with higher quality accuracy of the electrostatic image code 31*a* with a proper transfer voltage.

Also by the pre-charging control in this embodiment, with respect to the positional deviation of the respective color images of the output images at the time after the lapse of 200 hours from the start of the use in the brand-new state, a result which bears comparison with that in the brand-new state was obtained.

<Embodiment 6>

Figure 21:
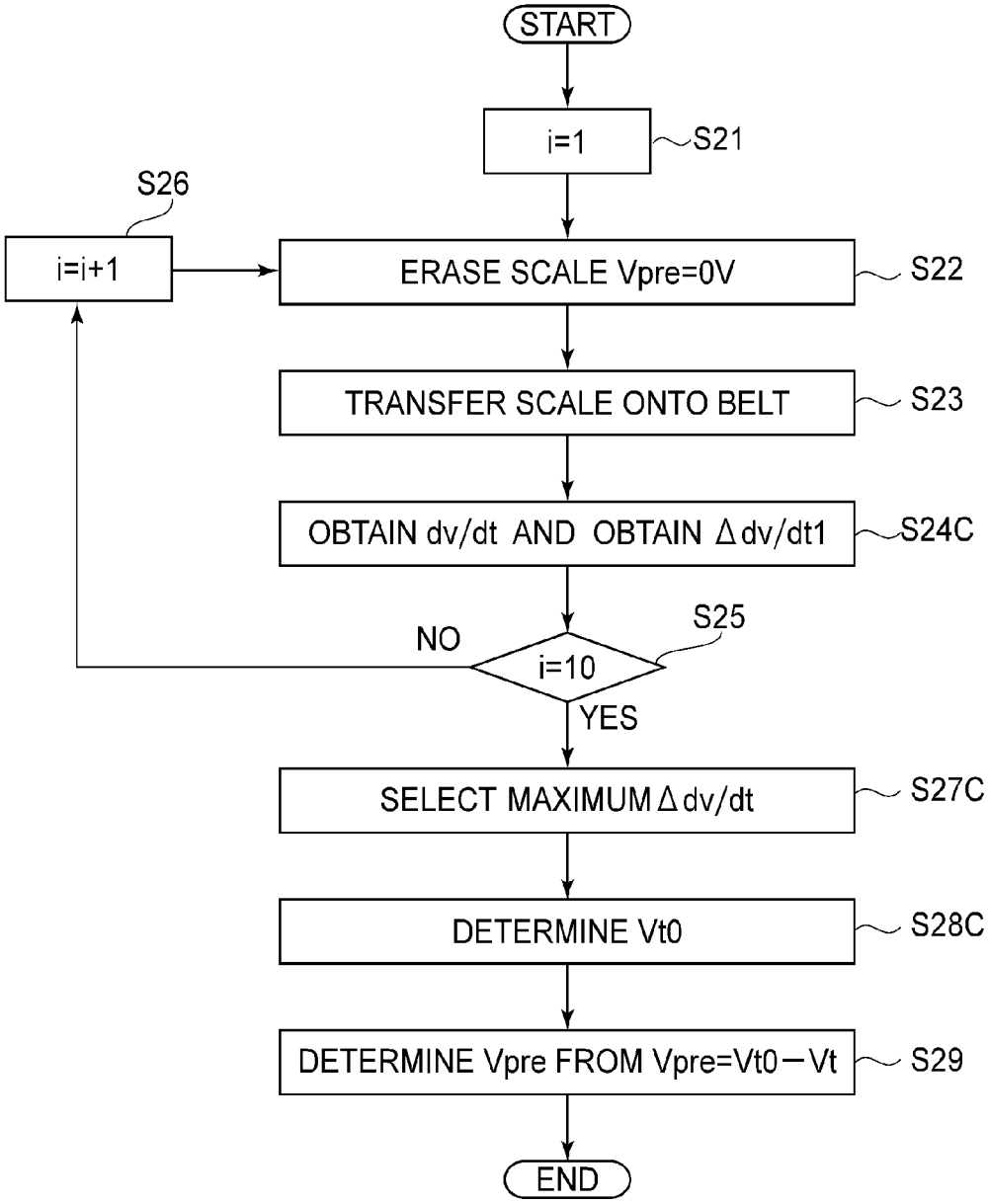

FIG. 21 is a flow chart of contact control in Embodiment 6. This embodiment is the same as Embodiment 5 except for the evaluation method of the output waveform of the antenna potential sensor and therefore in the figure, the same control as Embodiment 5 will be omitted from description by adding the common step numbers.

As shown in FIG. 21 with reference to FIG. 20, the controller 54 detects, in the image forming portion 43*a*, the electrostatic image code 31*a* transferred at the transfer voltage V1=500 V in the image forming portion 43*a*. Then, output induced current of the belt code reading sensor 33*b* is converted into a voltage value and then is a differential dv/dt waveform of the output waveform thereof is obtained. An average of an amplitude of the dv/dt waveform is obtained and is stored, as a differential amplitude Δdv/dt1 at the transfer voltage V1, in the memory (S24C). This operation is repeated to obtain output amplitudes Vout1 to Vout10 at transfer voltages V1=500 V to V10=1400 V (S21 to S26).

Thereafter, the controller 54 selects a maximum differential amplitude Δdv/dtMAX of the differential amplitudes Δdv/dt1 to Δdv/dt10 (S27C).

Then, the transfer voltage Vi at the maximum differential amplitude Δdv/dtMAX is taken as the belt surface potential Vt0 optimum for the transfer of the electrostatic image code 31*a* (S28C). This is because the differential amplitude when being detected by the antenna potential sensor is larger with higher quality accuracy of the electrostatic image code 31*a* with a proper transfer voltage.

Also by the pre-charging control in this embodiment, with respect to the positional deviation of the respective color images of the output images at the time after the lapse of 200 hours from the start of the use in the brand-new state, a result which bears comparison with that in the brand-new state was obtained.

<Embodiment 7>

Figure 22:
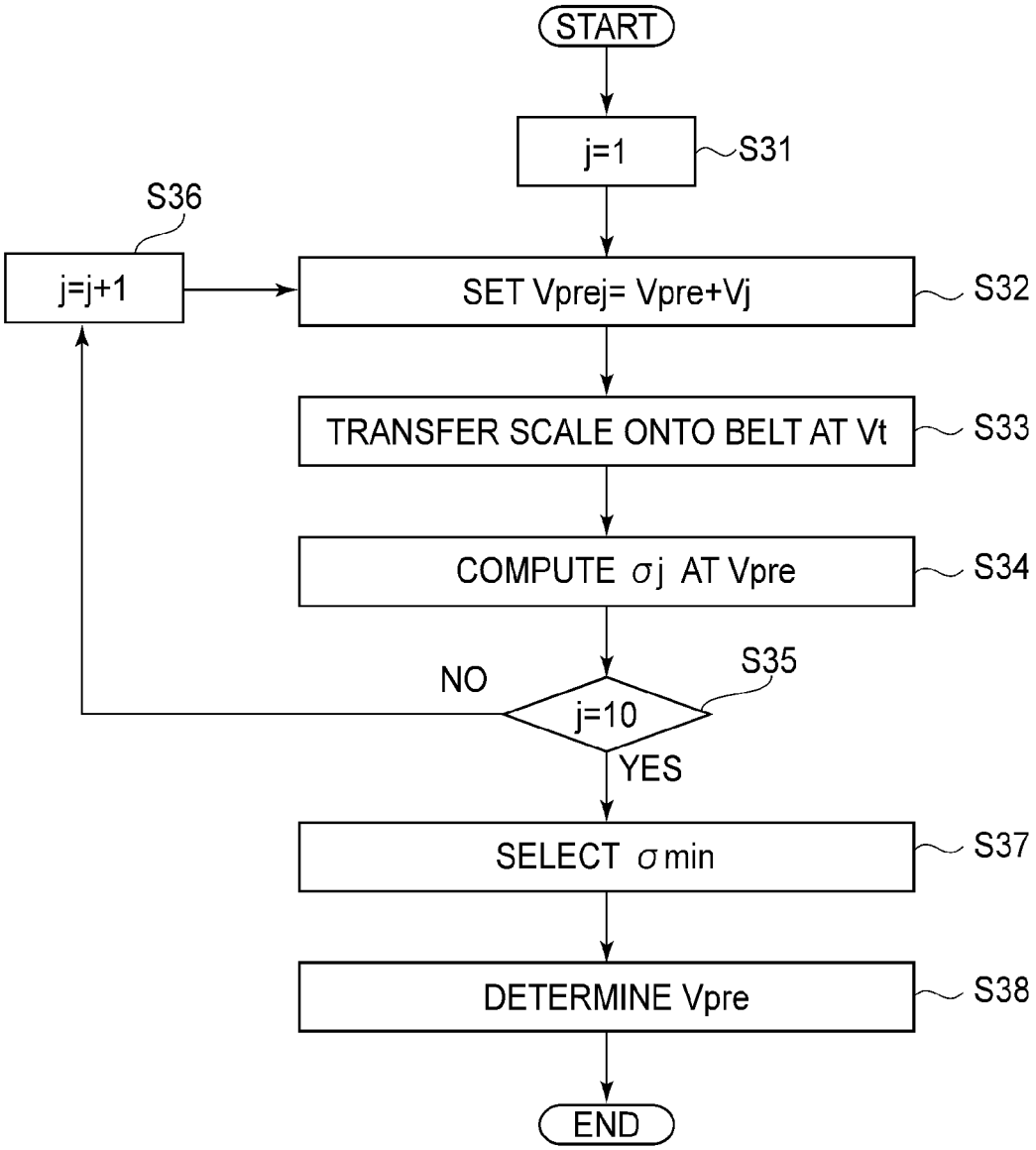

FIG. 22 is a flow chart of pre-charging control in Embodiment 7. In this embodiment, the pre-charging potential Vpre is determined by the method in Embodiments 4 to 6 and thereafter the pre-charging potential Vpre optimum for the transfer of the electrostatic image code 31*a* is extracted with further increased accuracy.

In Embodiments 4 to 6, when the pre-charging potential Vpre was obtained, the transfer of the electrostatic image code 31*a* was performed at the transfer voltage Vi at 10 levels from 500 V increasing with the increment of 100 V and then the quality accuracy of the electrostatic image code 31*a* after the transfer was evaluated to select an optimum value of the transfer voltage Vi. For this reason, the determined optimum pre-charging potential Vpre was obtained with the increment of 100 V. In this embodiment, thereafter, the pre-charging potential Vpre is changed at 10 levels with the increment of 10 V and the transfer of the electrostatic image code 31*a* is effected and then the quality accuracy of the electrostatic image code 31*a* after the transfer is evaluated to select the optimum value of the pre-charging potential Vpre. For this reason, the determined optimum pre-charging potential Vpre is obtained with the increment of 10 V.

The controller 54 which is the example of the control means changes the DC voltage of the voltage at a plurality of levels with the increment of 10 V, so that the electrostatic image code 31*a* is transferred onto the electrostatic image transfer area 25. Then, on the basis of a detection result of the electrostatic image code 31*a* transferred on the electrostatic image transfer area 25 by the antenna potential sensor 330, the DC voltage of the oscillating voltage used during the image formation is determined.

The controller 54 determines the DC voltage of the voltage so that the variation in waveform of the detection signal of the electrostatic image code 31*a* by the antenna potential sensor 330.

As shown in FIG. 17, in this embodiment, similarly as in Embodiment 4, the electrostatic image code 31*a* of the electrostatic image transfer area 25 is detected and an output signal of the detection is evaluated, so that the optimum pre-charging potential Vpre is set. The pre-charging potential Vpre is changed at 10 levels and other factors are kept at the same conditions, so that the electrostatic image code 31*a* is transferred onto the electrostatic image transfer area 25, and the pre-charging potential Vpre with least disturbance of the output signal when being detected by the belt code reading sensors 33*b* and 33*b*'.

As shown in (*a*) of FIG. 17, during the transfer of the electrostatic image code 31*a*, when the pre-charging potential Vpre form the electrostatic image transfer area 25 is proper, the electrostatic image code 31*a* is regularly transferred onto the electrostatic image transfer area 25 by normal electric discharge. In this case, as shown in (*a*) of FIG. 18, the output signals of the belt code reading sensors 33*b* and 33*b*' are regularly aligned in phase, so that a standard deviation σ of a period (cycle) of a plurality of signal waveforms becomes small.

As shown in (*b*) of FIG. 17, during the transfer of the electrostatic image code 31*a*, when the pre-charging potential Vpre for the electrostatic image transfer area 25 is improper, the electrostatic image code 31*a* is regularly transferred onto the electrostatic image transfer area 25 by abnormal electric discharge. In this case, as shown in (*b*) of FIG. 18, the output signals of the belt code reading sensors 33*b* and 33*b*' are irregularly disturbed in phase, so that a standard deviation σ of a period (cycle) of a plurality of signal waveforms becomes large.

Therefore, the standard deviations σ of the periods of the plurality of signal waveforms are obtained and compared with each other, so that the transfer quality of the electrostatic image codes 31*a* different in pre-charging potential Vpre can be evaluated.

As shown in FIG. 22 with reference to FIG. 3, it is assumed that the surface potential Vt0 optimum for the transfer of the electrostatic image code 31*a* is set at 900 V, the transfer voltage optimum for the transfer of the toner image for the image is set at 1170 V, and the pre-charging potential Vpre is set at −270 through the process in Embodiment 4. Here, the process in Embodiment 4 may also be represented with the process in Embodiment 5 or 6.

Then, the controller 54 sets a pre-charging potential Vprej with variables V1, V2, V3 . . . V10 varying as Vj at 10 levels from −50 V to +40 V with the increment of 10 V in the following manner. Here, the range of Vj and the increment of 10 V may arbitrarily selected and may also be changed depending on a degree of progress of the change in electrophotographic process with time or a balance with the printing speed.

$$Vprej=-240\ V+Vj$$

The controller 54 first sets j at 1 (j=1) (S31) and then sets the DC voltage of the oscillating voltage, applied to the code erasing roller 52, as the pre-charging potential Vpre1 (S32).

The controller 54 forms, in the image forming portion 43*a*, the electrostatic image code 31*a* of 4 lines and 4 spaces at the resolution of 600 dpi on the photosensitive drum 12*a* and then applies the transfer voltage Vt=1170 V to the primary transfer roller 51, so that the electrostatic image code 31*a* is transferred onto the intermediary transfer belt 24 (S33).

The controller 54 detects the induced current of the electrostatic image code 31*a* by the two between reading sensors 33*b* and 33*b*' in the image forming portion 43*b*. Then, a difference in rise time to which the signal waveform corresponds is obtained, and its standard deviation σj is stored in the memory as reading accuracy at the pre-charging potential Vpre1 (S34).

In the case where j is not 10 (NO of S35), the controller 54 sets j at j+1 (j=j+1) (S36) and then repeats the similar operations to obtain standard deviation σj=σ1 to σ10 of the rise time difference with respect to the signal waveforms from Vpre1 to Vpre10 (S31 to S36).

Thereafter, the controller 54 selects a σminimum min from the values σ1 to σ10 (S37) to determine Vprej providing the minimum σmin and then uses Vprej as the pre-charging potential Vpre from subsequent pre-charging control (S38).

In the pre-charging control in this embodiment, the optimum value of the pre-charging potential Vpre is set with the increment of 10 V and therefore the pre-charging potential Vpre can be properly set more than the case of Embodiment 4 in which the increment is 100 V. The pre-charging potential of the electrostatic image transfer area 25 of the intermediary transfer belt 24 is interrelated with the change in transfer voltage, for the toner image for the image, varying depending on the ambient temperature and humidity during the operation, so that it is possible to always correct the color misregistration even when the environment is changed. Simultaneously with or in parallel to the continuous image formation, the pre-charging potential Vpre can be adjusted to the optimum value, so that the pre-charging control can meet the abrupt change in environmental condition and changes with time of a mechanism and physical values of the electrophotographic process in a short time. As a result, from the start of use in the brand-new state to the time after the lapse of 300 hours from the start, with respect to the positional deviation of the respective color images for the output image, a result which bore comparison with that in the brand-new state was obtained.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 244590/2010 filed Oct. 29, 2010, which is hereby incorporated by reference herein.

What is claimed is:

1. An image forming apparatus comprising:

a first image bearing member;

a belt member contacting said first image bearing member;

a first latent image forming unit configured to form an electrostatic latent image including a first latent image and a first latent index pattern on said first image bearing member;

a first developing member configured to form a first toner image from the first latent image formed on said first image bearing member;

a first transfer member configured to transfer the first toner image and the first latent index pattern from said first image bearing member onto said belt member;

a first detecting member configured to detect a transferred first latent index pattern onto said belt member;

a second image bearing member configured to be disposed at a position downstream of said first image bearing member with respect to a moving direction of said belt member and to contact said belt member;

a second latent image forming unit configured to form an electrostatic latent image including a second latent image and a second latent index pattern on said second image bearing member;

a second developing member configured to form a second toner image from the second latent image formed on said second image bearing member;

a second transfer member configured to transfer the second toner image from said second image bearing member onto said belt member;

a second detecting member configured to detect the second latent index pattern formed on said second image bearing member;

an adjusting portion configured to adjust a forming operation of the first latent index pattern and the second latent index pattern on the basis of an output of said first detecting member and an output of said second detecting member; and a belt charging member configured to be disposed at a position upstream of said first image bearing member and downstream of said second image bearing member with respect to the moving direction of said belt member, and configured to electrically charge a region, of said belt member, which is different from a region of the first toner image and which overlaps with the first latent index pattern with respect to a widthwise direction perpendicular to the moving direction of said belt member.

2. An image forming apparatus according to claim 1, wherein said belt member has a toner image transfer area associated with an area of said first and second image bearing members in which the toner image for the image is to be carried, and a latent pattern transfer area, provided outside the toner image transfer area with respect to the widthwise direction of said belt member, in which a resistance value is made higher than that in the toner image transfer area and the first and second latent index patterns are to be transferred, and wherein the first latent index pattern transferred from said first image bearing member onto said belt member is used to adjust a relative position between the first toner image and the second toner image transferred onto said belt member with respect to the moving direction of said belt member.

3. An image forming apparatus according to claim 2, wherein said belt charging member charges the latent pattern transfer area to a potential of a DC voltage by being supplied with an oscillating voltage, in the form of an AC voltage biased with the DC voltage, in contact with the latent pattern transfer area.

4. An image forming apparatus according to claim 3, wherein said belt charging member erases a preceding latent index pattern transferred onto the latent pattern transfer area.

5. An image forming apparatus according to claim 3, further comprising a setting portion configured to set the DC voltage of the voltage on the basis of a detection result of the first latent index pattern, by said first detecting member, formed and then transferred onto the latent pattern transfer area under application of a voltage, changed at a plurality of levels.

6. An image forming apparatus according to claim 5, wherein the DC voltage of the voltage applied to said belt charging member is determined so that a variation in waveform of a detection signal of the first latent index pattern by said first detecting member is small.

7. An image forming apparatus according to claim 3, further comprising a setting portion configured to set the DC voltage of the voltage on the basis of a detection result of the first latent index pattern, by said first detecting member, formed and then transferred onto the latent pattern transfer area under application of the DC voltage, of the oscillating voltage changed at a plurality of levels.

8. An image forming apparatus according to claim 7, wherein the DC voltage of the voltage applied to said belt charging member is determined so that a variation in waveform of a detection signal of the first latent index pattern by the said first detecting member is small.

9. An image forming apparatus according to claim 1, wherein each of the first and second latent index patterns is formed so that a plurality of linear patterns each extending in the widthwise direction with a predetermined width are arranged in a moving direction of said image bearing member, and wherein each of said first detecting member and said second detecting member includes a linear probe provided with respect to a direction substantially perpendicular to the linear patterns each extending in the widthwise direction.

* * * * *